US007967401B2

(12) United States Patent
Hsu

(10) Patent No.: US 7,967,401 B2
(45) Date of Patent: Jun. 28, 2011

(54) SYSTEMIC CABINET

(76) Inventor: Li-Chung Hsu, Tanzih (TW)

( * ) Notice: Subject to any disclaimer, the term of this patent is extended or adjusted under 35 U.S.C. 154(b) by 0 days.

(21) Appl. No.: 12/321,167

(22) Filed: Jan. 21, 2009

(65) Prior Publication Data

US 2010/0181881 A1 Jul. 22, 2010

(51) Int. Cl.
*A47B 47/00* (2006.01)

(52) U.S. Cl. ..... 312/257.1; 312/108; 312/111

(58) Field of Classification Search ..... 312/107, 312/108, 111, 114, 140, 257.1, 263, 265.1, 312/265.5; 403/171, 176, 381, 403
See application file for complete search history.

(56) References Cited

U.S. PATENT DOCUMENTS

| | | | | | |
|---|---|---|---|---|---|
| 1,898,297 | A * | 2/1933 | Fox | 446/122 |
| 3,491,896 | A * | 1/1970 | Crary | 108/60 |
| 3,547,472 | A * | 12/1970 | Ehrman | 403/381 |
| 3,661,434 | A * | 5/1972 | Alster | 312/111 |
| 3,901,572 | A * | 8/1975 | Litchfield | 312/348.2 |
| 3,901,613 | A * | 8/1975 | Andersson | 403/178 |
| 4,045,104 | A * | 8/1977 | Peterson | 312/265.4 |
| 4,125,338 | A * | 11/1978 | Lew | 403/169 |
| 4,683,634 | A * | 8/1987 | Cole | 29/412 |
| 4,782,637 | A * | 11/1988 | Eriksson et al. | 52/280 |
| 5,003,741 | A * | 4/1991 | Yeh | 52/280 |
| 5,144,780 | A * | 9/1992 | Gieling et al. | 52/298 |
| 5,470,139 | A * | 11/1995 | Hsiao | 312/140 |
| 5,588,726 | A * | 12/1996 | Lee | 312/263 |
| 5,695,263 | A * | 12/1997 | Simon et al. | 312/265.4 |
| 5,820,289 | A * | 10/1998 | Kern et al. | 403/231 |
| 5,893,617 | A * | 4/1999 | Lee | 312/263 |
| 6,332,657 | B1 * | 12/2001 | Fischer | 312/111 |
| 6,474,759 | B2 * | 11/2002 | Hsu | 312/263 |
| 6,561,603 | B2 * | 5/2003 | Knab et al. | 312/265.4 |
| 6,881,005 | B2 * | 4/2005 | Sosa | 403/395 |
| 2006/0165482 | A1 * | 7/2006 | Olberding | 403/381 |

* cited by examiner

*Primary Examiner* — James O Hansen
(74) *Attorney, Agent, or Firm* — Alan Kamrath; Kamrath & Associates PA

(57) ABSTRACT

A systemic cabinet is composed of multiple boards and multiple connecting pieces. Each board has multiple mortises defined at sides respectively to combine the corresponding connecting pieces with supporting strength by wedging to form a configuration of the systemic cabinet. The connecting pieces have multiple types in design variation to provide orientation-positioning efficiency and have supporting strength to make the composed systemic cabinet firm and stable. Therefore, once one board is worn out, only the worn board is replaced by detaching the connecting pieces to save other elements and to make the replacement easy and environmental for future repair.

12 Claims, 25 Drawing Sheets

SYSTEMIC CABINET

BACKGROUND OF THE INVENTION

1. Field of the Invention

The present invention relates to a systemic cabinet and, more particularly, to a systemic cabinet composed of multiple assembling boards and corresponding connecting pieces having supporting strength so that this systemic cabinet can be assembled or disassembled rapidly and conveniently and has various embodiments according to different uses such as CD frames, grocery racks, closets, book shelves, shoe cabinets, etc.

2. Description of Related Art

In the current market of systemic cabinets, manufacturers focus on design and process to increase the utility and transportation convenience of the systemic cabinet. Therefore, conventional systemic cabinets are mostly sold in assembling kits that have to be constructed by DIY and secured immovably by tools to form the final frames or cabinets after consumers purchase them. Once the frames or the cabinets are worn too much to use, the whole systemic cabinet will be dumped directly, because it is troublesome and time-consuming to disassemble the conventional systemic cabinet into pieces. Therefore, the wasted conventional systemic cabinets are not environmental friendly.

SUMMARY OF THE INVENTION

A main objective of the present invention is to provide a systemic cabinet that has multiple boards each having mortises defined at two opposite sides engaged by corresponding connecting pieces with supporting strength to achieve combination. By assembling the multiple boards with the connecting pieces, the systemic cabinet is constructed quickly and conveniently by wedging in the operation of combination. The connecting pieces have multiple types in design variation to provide different orientation-positioning efficiency and have supporting strength to make the composed systemic cabinet firm and stable. Therefore, once one board is worn and needed to be replaced, only the worn board is changed by detaching the relative connecting pieces to save other elements and to make the replacement easy and environmental for future repair.

To achieve the foregoing objective, the systemic cabinet comprises multiple boards and multiple connecting pieces between adjacent two of the multiple boards. The improvement of the systemic cabinet is that:

each of the multiple connecting pieces has two ends inserted into two mortises on adjacent two of the multiple boards respectively.

each of the multiple connecting pieces has two ends inserting into two mortises on adjacent two of the multiple boards respectively.

Further benefits and advantages of the present invention will become apparent after a careful reading of the detailed description with appropriate reference to the accompanying drawings.

DETAILED DESCRIPTION OF THE PREFERRED EMBODIMENT

A systemic cabinet in accordance with the present invention is composed of multiple boards and multiple connecting pieces. Each board has multiple mortises defined at opposite sides respectively to combine the corresponding connecting pieces with supporting strength by wedging to form compartments of the systemic cabinet. The connecting pieces have multiple variations in design to provide orientation-positioning efficiency and have supporting strength to make the composed systemic cabinet firm and stable. Therefore, once one board is worn out, only the worn board is replaced by detaching the connecting pieces to save other elements and to make the replacement easy and environmental for future repair.

Figure 1:
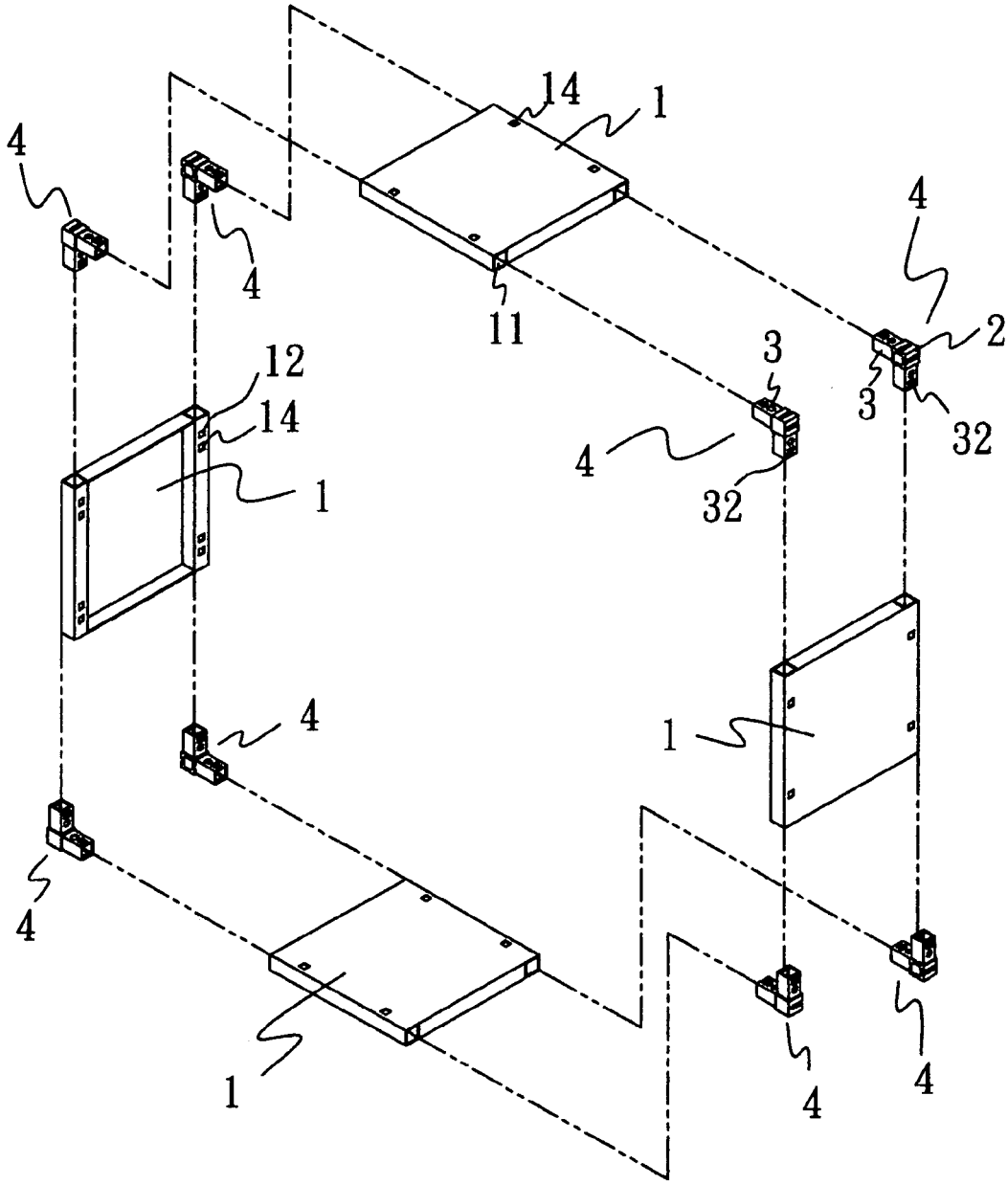
FIG. 1 is an exploded perspective view of the first embodiment showing a unit component of the systemic cabinet in accordance with the present invention.

As shown in FIG. 1, a single unit compartment of a systemic cabinet comprises multiple boards 1 and multiple connecting pieces 4 at corners of the unit compartment.

Each board 1 is rectangular and has a predetermined width based on a total configuration in design. Two opposite sides of the board 1 have four mortises 11 defined at ends and four locking holes 12 defined on one face of the board 1 to communicate with the mortises 11 respectively. Such boards 1 are uniform and defined as top boards, bottom boards, sideboards, bridging boards, erecting boards, adjacent boards, or widened boards as applied to different orientations and modifications mentioned below.

Figure 2B:
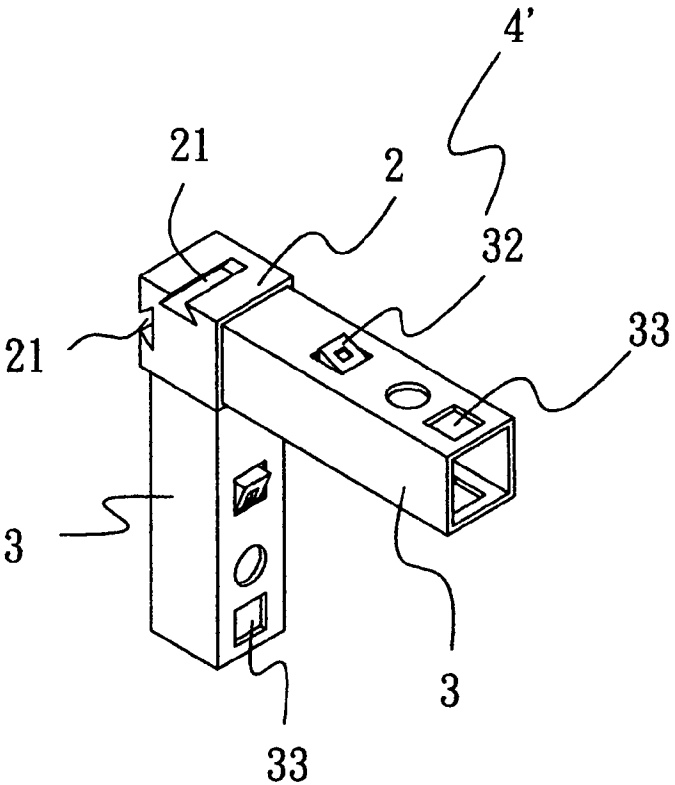
FIGS. 2A and 2B are perspective views showing two different types of connecting pieces of the systemic cabinet in accordance with the present invention.
Figure 2A:
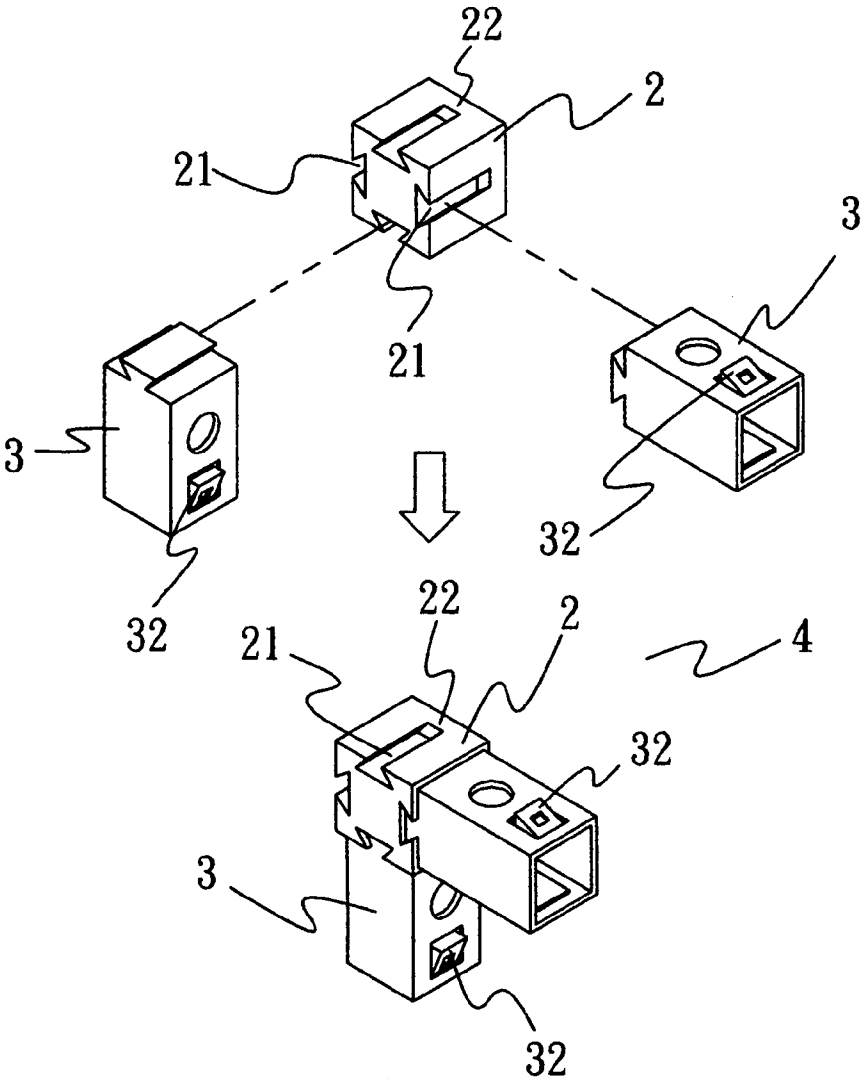
Figure 4:
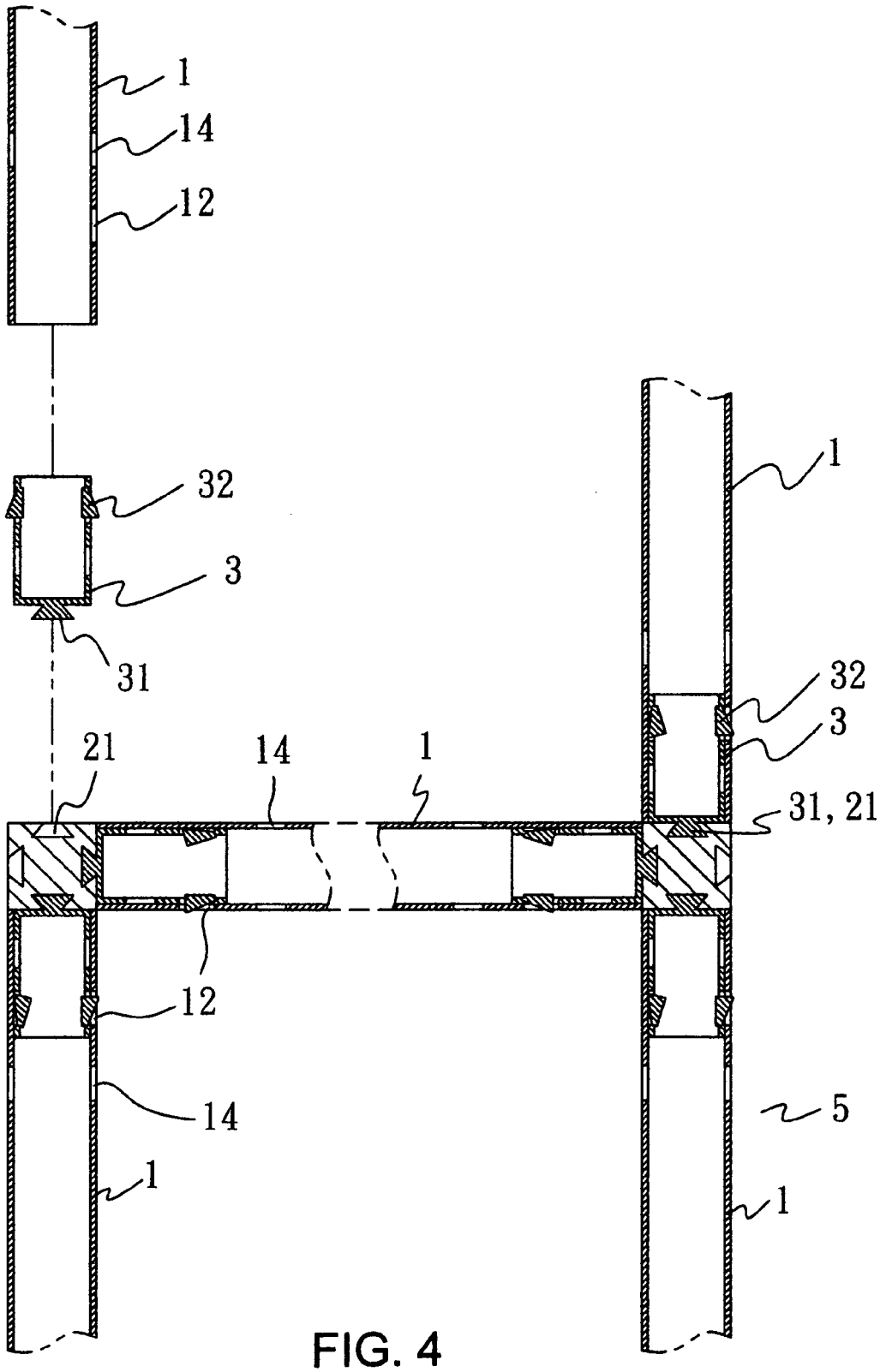
FIG. 4 is an enlarged cross-sectional side view showing joints of the connecting pieces and relative boards of the systemic cabinet in FIG. 3.

Each connecting piece 4 as shown in FIG. 2A has a solid locking body 2 and at least one tenon tube 3. The locking body 2 has multiple dovetail-grooves 21 defined on faces respectively to engage a dovetail-insertion 31 formed on the corresponding tenon tube 3. The dovetail-grooves 21 do not entirely transverse through the face of the locking body 2 to reserve a block section 22 (see FIG. 2A) to keep the corresponding tenon tube 3 engaged at a limited position. As shown in FIG. 4, cross section of the locking body 2 perpendicular to the dovetail-grooves 21 are solid. Additionally, each tenon tube 3 has a protrusion 32 formed on a top face to align with the locking hole 12 on the board 1.

As shown in FIG. 2B, another type of the connecting piece 4' is that the tenon tube 3 and the locking body 2 are integrated into one-piece. Such a connecting piece 4' is embodied to apply to a widened cabinet with widened boards. The connecting piece 4' has its length, the locking holes 33, and the protrusions 32 arranged and decided by the supporting strength required for the widened board 1.

With regard to assembly of the aforementioned multiple boards 1 and the multiple connecting pieces 4 as shown in FIG. 1, the tenon tube 3 at one end of the connecting piece 4 is inserted into the mortise 11 on one adjacent board 1 until the protrusion 32 on the tenon tube 3 engages the locking hole 12 on the board. By having the multiple connecting pieces 4 each composed of a locking body 2 and optional multiple tenon tubes 3, the boards 1 with predetermined sizes are combined and constructed to form a unit component 5, shown in FIG. 3 as a narrow cabinet as an embodiment, easily and conveniently by wedging.

Figure 3:
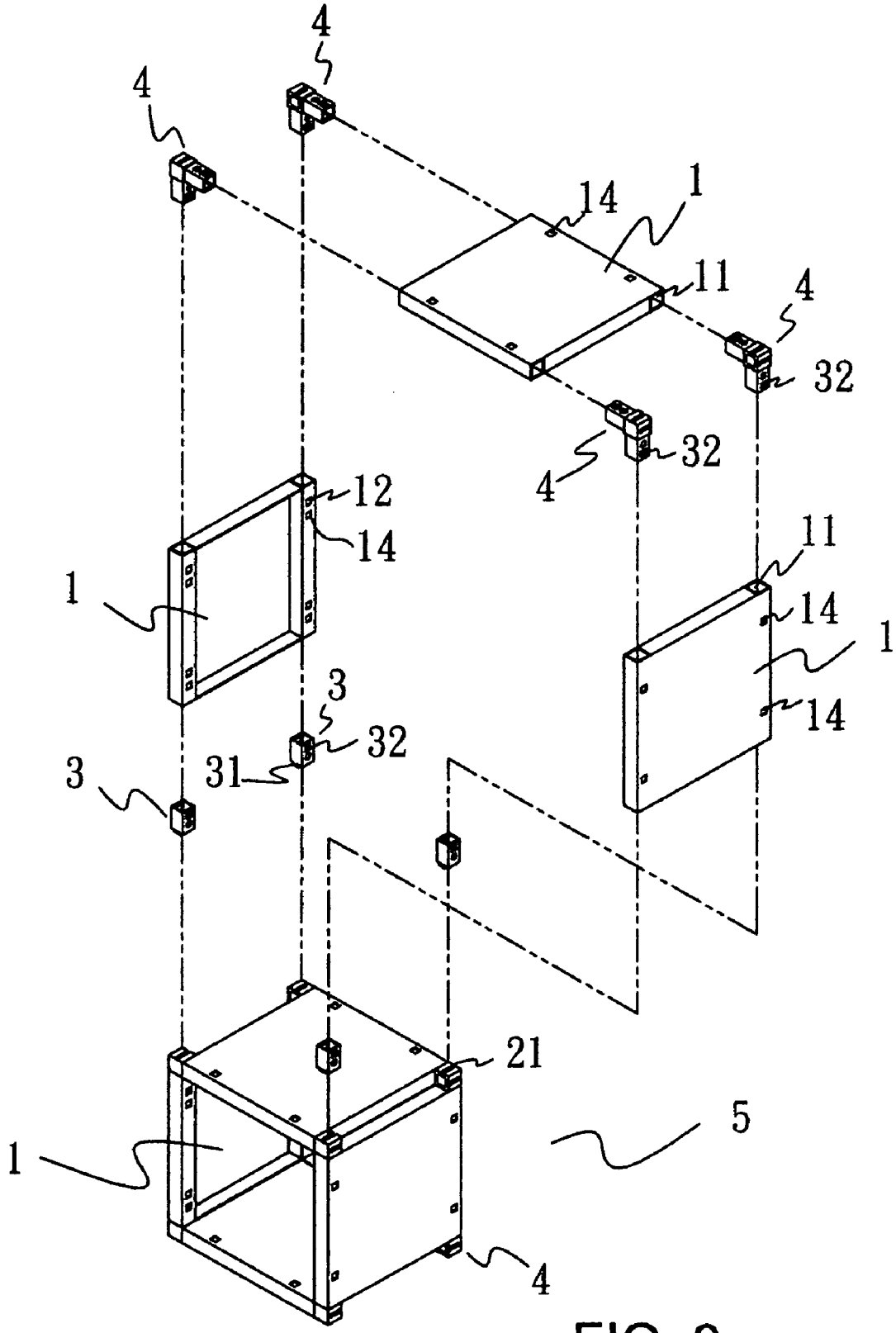
FIG. 3 is an exploded perspective view of the second embodiment of the systemic cabinet in accordance with the present invention.

When it is desired to add the unit component 5 to more compartments as shown in FIGS. 3 and 4, four tenon tubes 3 combined to the corresponding locking bodies 2 are added at corners respectively by engaging the dovetail-insertions 31 with the dovetail-grooves 21 snugly as shown in FIG. 4. Moreover, each single tenon tube 3 inserted into the mortise 11 on a corresponding one of two erecting sideboards 1 is positioned by locking the protrusion 32 with the locking hole 12. Lastly, a bridging board 1 is mounted over the two erecting sideboards 1 by attaching four connecting pieces 4 at corners to form the systemic cabinet with two components.

Figure 5:
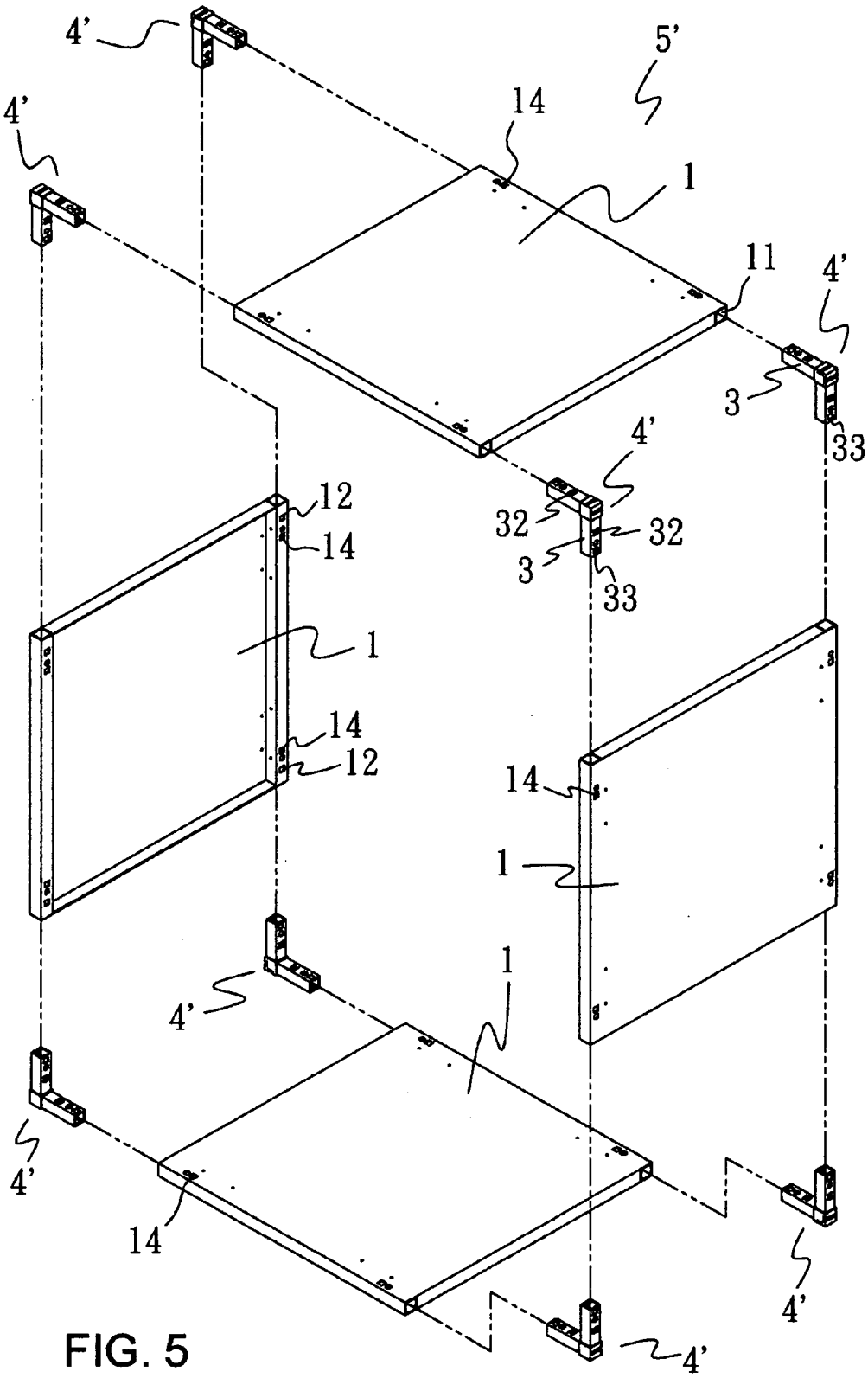
FIG. 5 is an exploded perspective view of the third embodiment showing an enlarged unit component of the systemic cabinet in accordance with the present invention.

With regard to another embodiment of the systemic cabinet having an enlarged size in assembly as shown in FIG. 5, the connecting piece 4' in one-piece has two tenon tubes 3 arranged vertically to each other to insert into two mortises 11 of two adjacent boards 1 respectively until the protrusions 32 engage the locking holes 12. Four boards 1 are arranged one by one in a loop, and eight connecting pieces 4' fix the corners for the four boards 1 by the above-mentioned ways to compose one compartment. Because the locking body 2 and the two tenon tubes 3 of the connecting piece 4' are in one piece, the connecting piece 4' provides sufficient supporting strength to the widened boards 1. By constructing and positioning the widened boards 1 with the one-pieced connecting pieces 4', the unit component 5' having one compartment is achieved as shown in FIG. 6.

Figure 6:
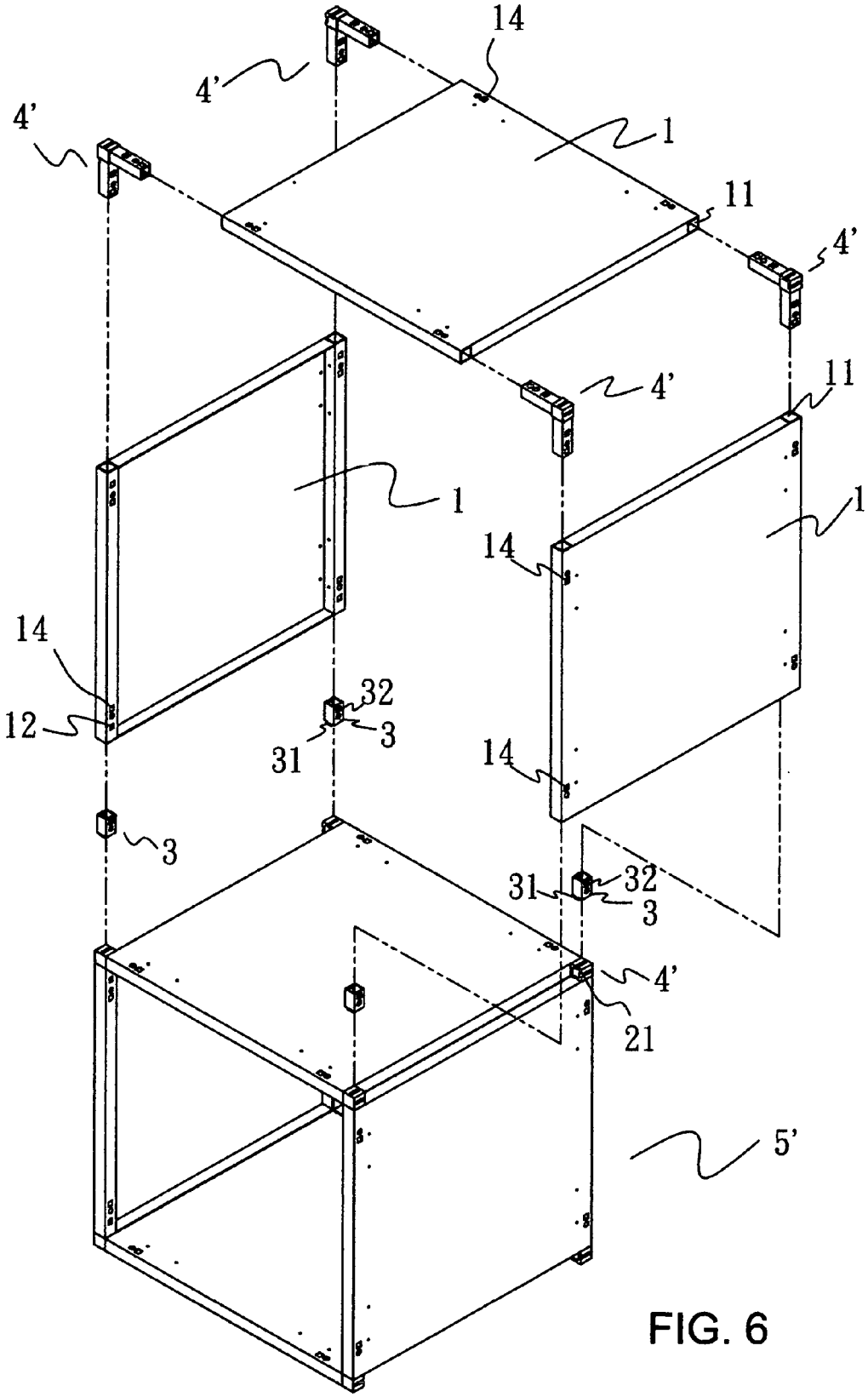
FIG. 6 is an exploded perspective view of the fourth embodiment of the enlarged unit component of the systemic cabinet in accordance with the present invention.
Figure 7:
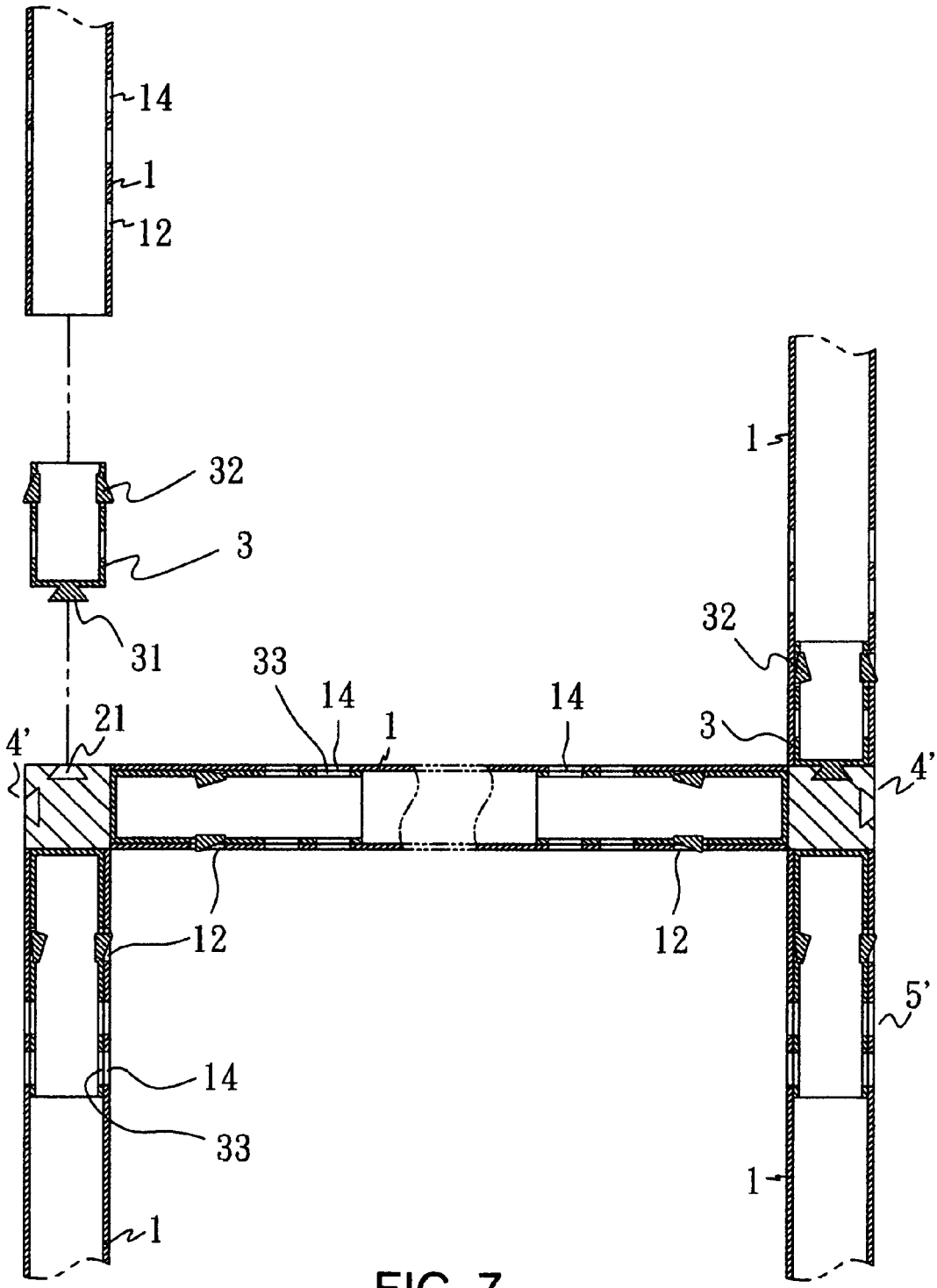
FIG. 7 is an enlarged cross-sectional side view showing joints of the connecting pieces and relative boards of the systemic cabinet in FIG. 6.

When it is desired to add the unit component 5' to more compartments as shown in FIGS. 6 and 7, four tenon tubes 3 combined to the corresponding locking bodies 2 are added at corners respectively by engaging the dovetail-insertions 31 with the dovetail-grooves 21 snugly as shown in FIG. 7. Moreover, each single tenon tube 3 inserted into the mortise 11 on corresponding one of two erecting sideboards 1 is positioned by locking the protrusion 32 with the locking hole 12. Lastly, a bridging board 1 is mounted over the two erecting sideboards 1 by attaching four connecting pieces 4' at corners to form the systemic cabinet having two components.

Figure 8:
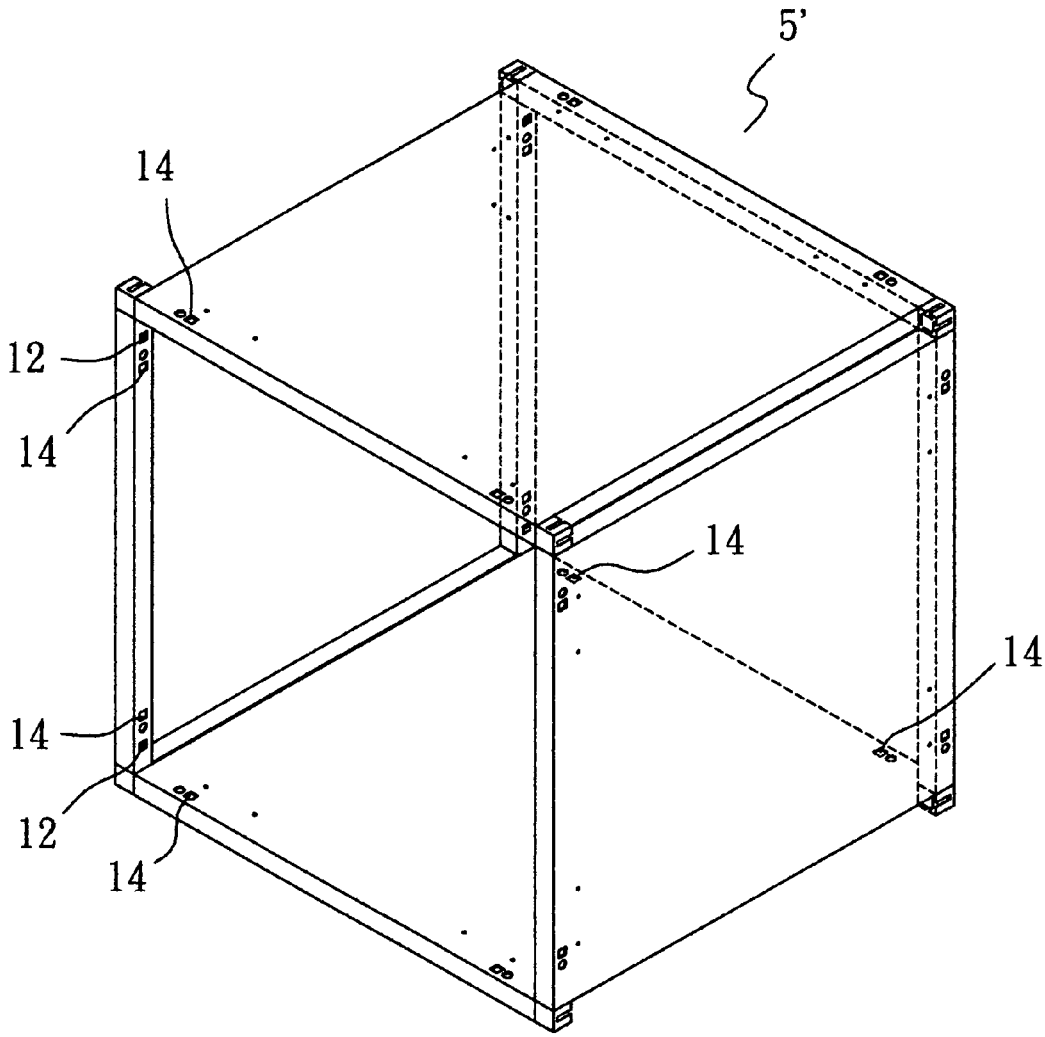
FIG. 8 is a perspective view of the third embodiment of the systemic cabinet in FIG. 5, wherein the enlarged unit component does not have front and rear boards.
Figure 9:
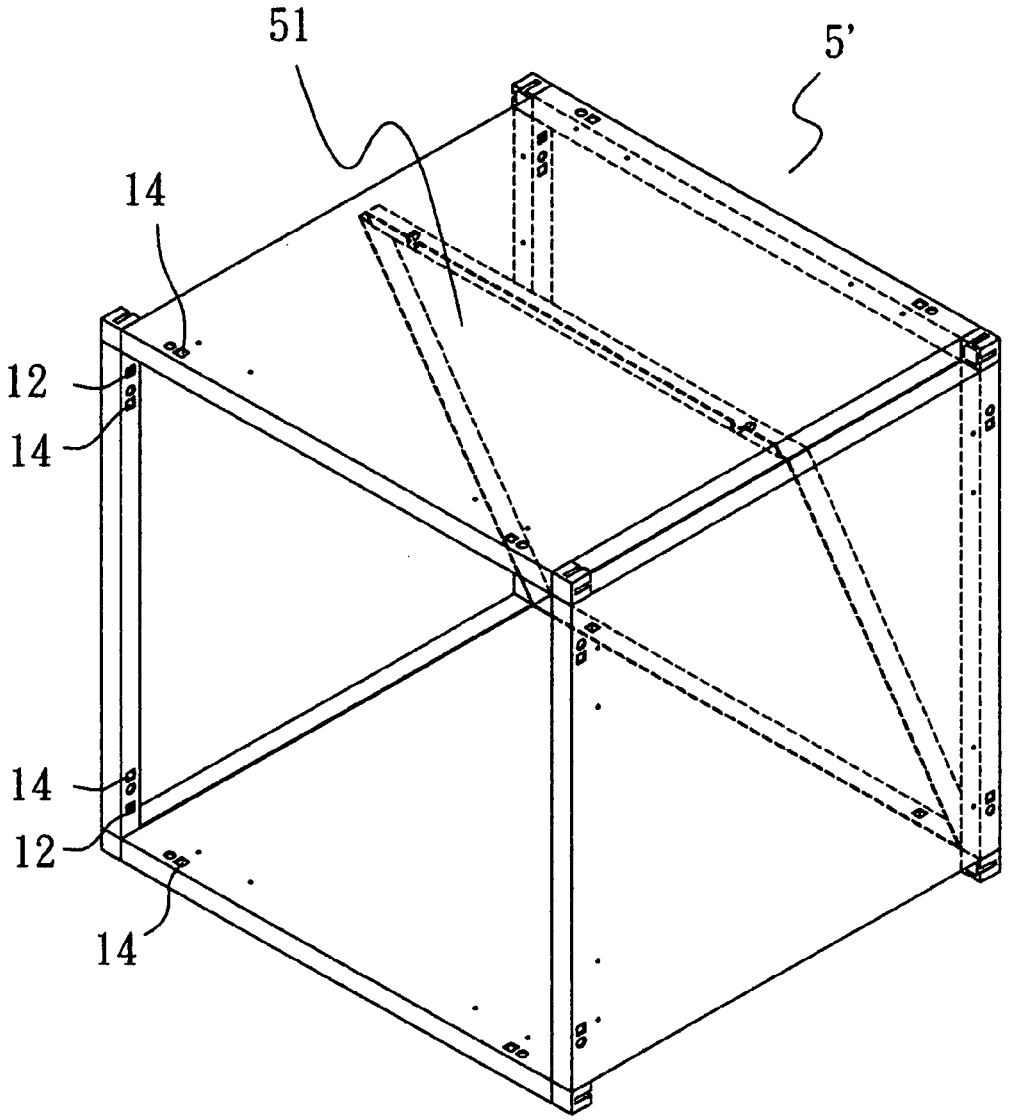
FIG. 9 is an operational perspective view of the systemic cabinet in FIG. 8 to illustrate the attachment of the rear board.
Figure 9A:
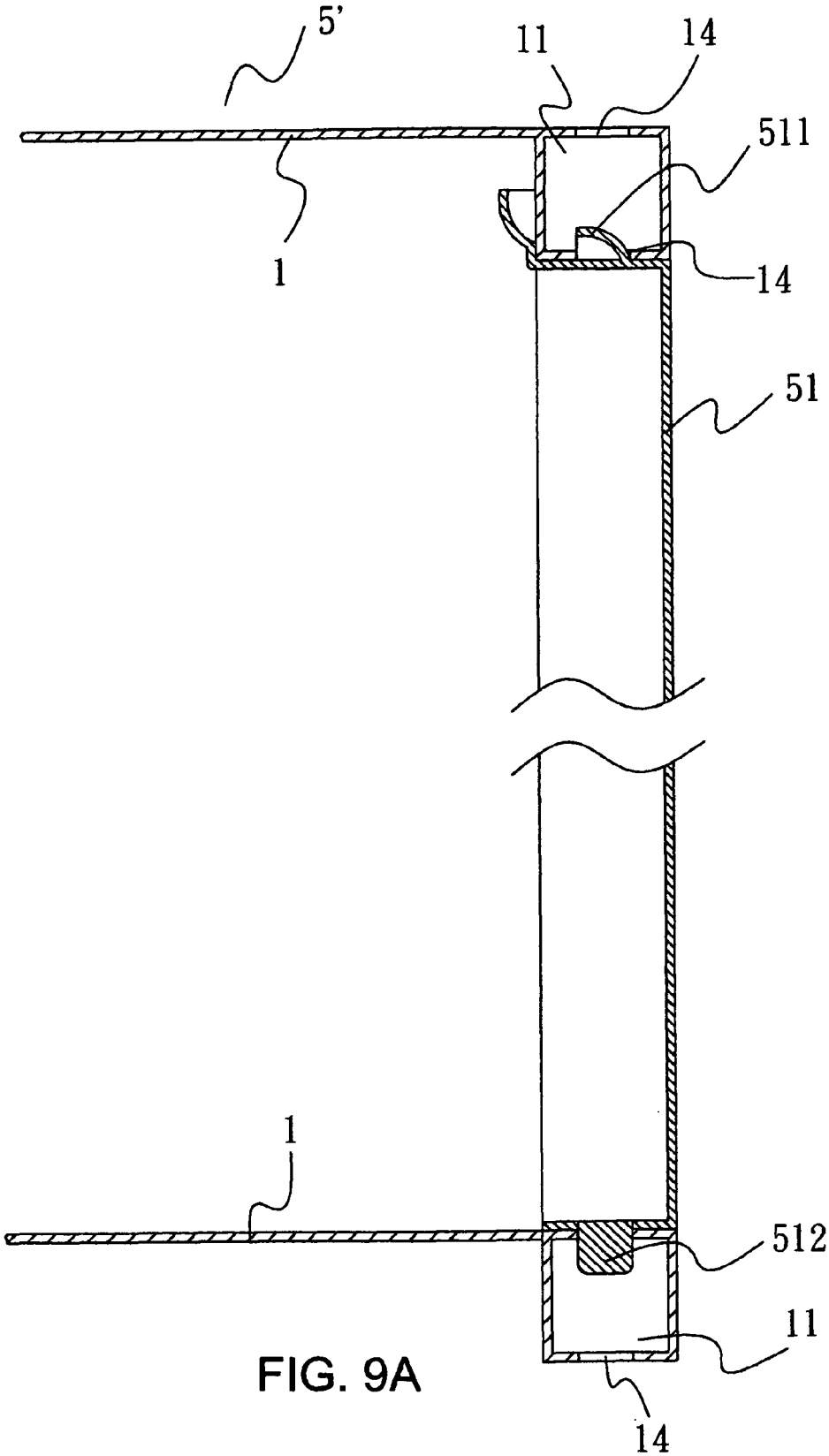
FIG. 9A is an enlarged cross-sectional view showing joints between the rear board and a top board or a rear board.
Figure 10:
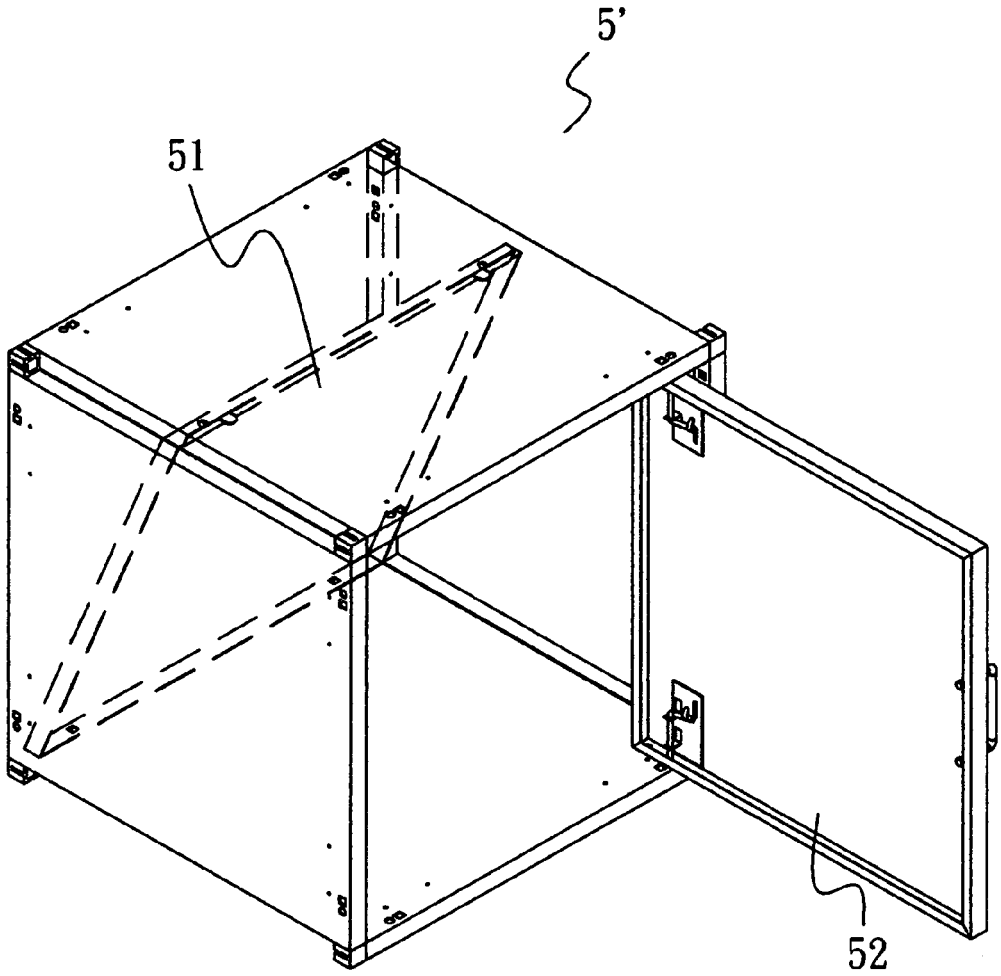
FIG. 10 is a perspective view of the systemic cabinet in FIG. 9 to show the attachment of the front board.
Figure 11:
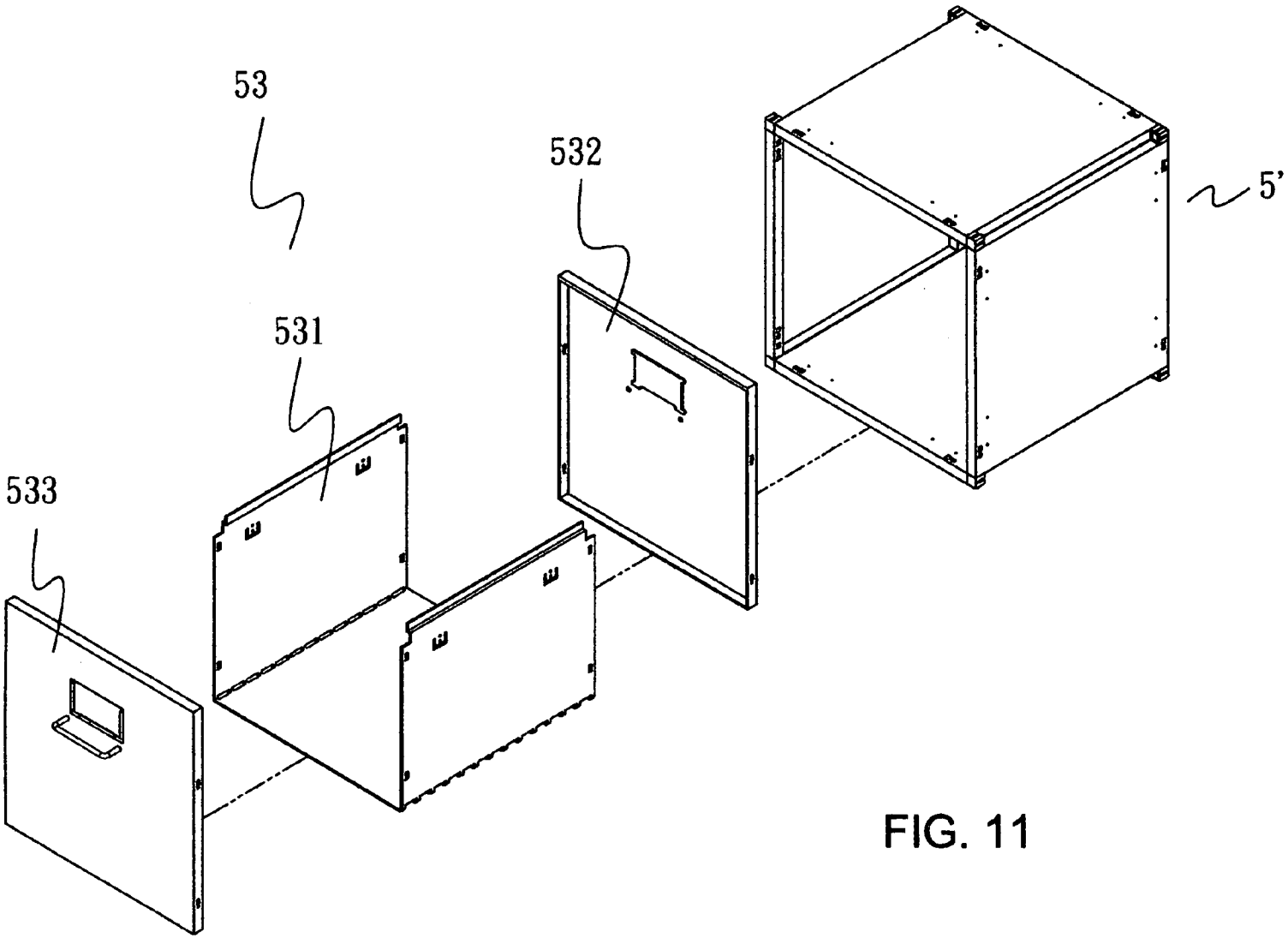
FIG. 11 is an exploded perspective view of the fifth embodiment of the systemic cabinet in FIG. 8 to combine with a drawer structure.
Figure 12:
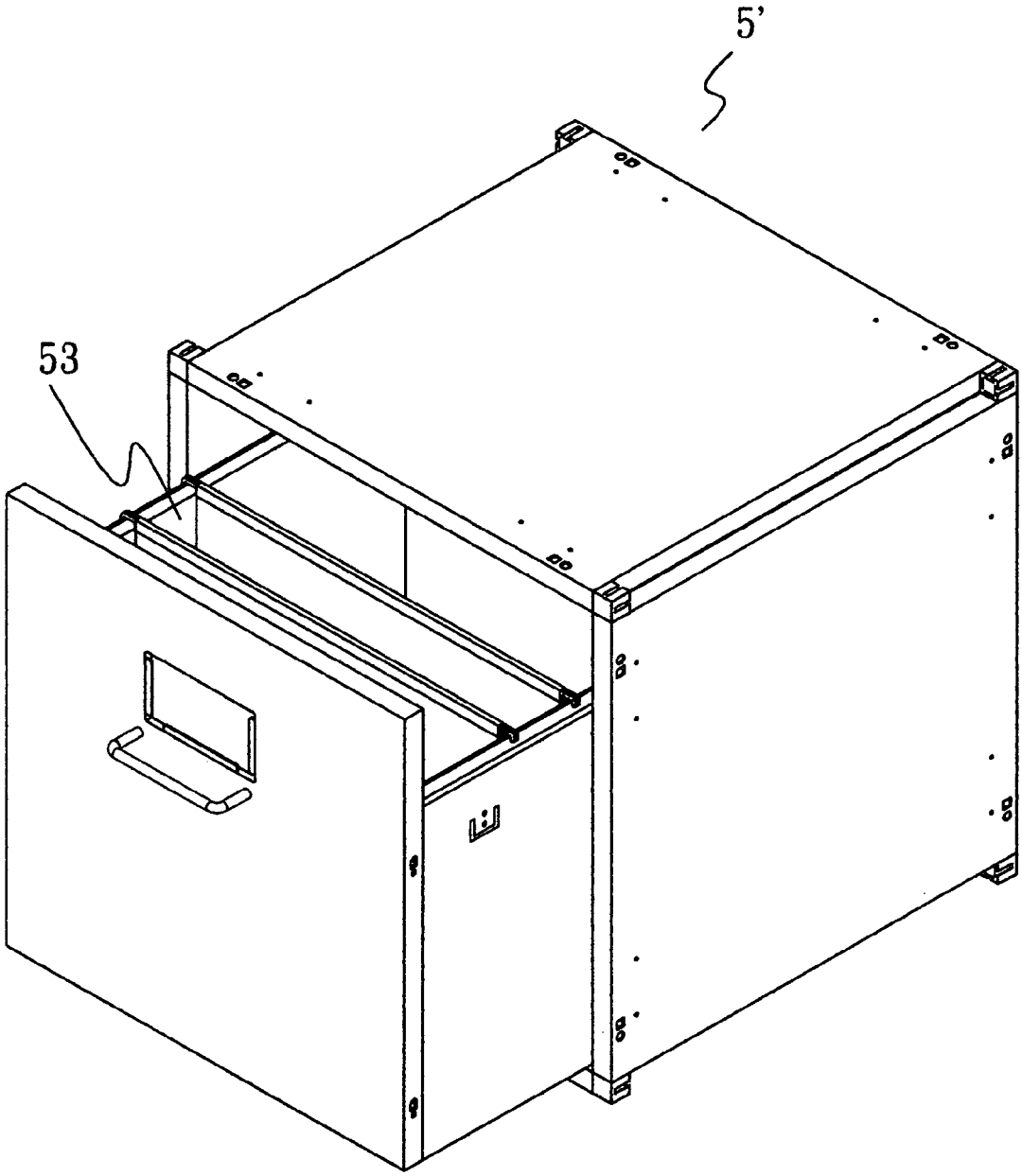
FIG. 12 is a perspective view of the systemic cabinet in FIG. 11.

The aforementioned unit compartment 5' is uncovered at the front and rear sides as shown in FIG. 8 and is selectively mounted with a rear board 51 as shown in FIG. 9. The rear board 51 has positioning protrusions 511, 512 wedging into corresponding through holes 14 defined on the top and bottom boards 1 for positioning as shown in FIGS. 9 and 9A. Two of the positioning protrusions 512 at the bottom are rectangular stubs, and two of the positioning protrusions 511 at the top are arc-shaped to allow the rear board 51 to be easily pushed into the space between the top and bottom boards 1. Moreover, the unit component 5' can be pivotally mounted with a front board 52 by hinges as shown in FIG. 10. Depending on the use of the unit component 5', a drawer 53 is accommodated inside as shown in FIG. 12 and is composed of a U-shaped case 531 with a front plate 533 and a rear plate 532 combined into one-piece as shown in FIG. 11, so that the combined drawer 53 is movably accommodated in the unit component 5'.

Figure 13:
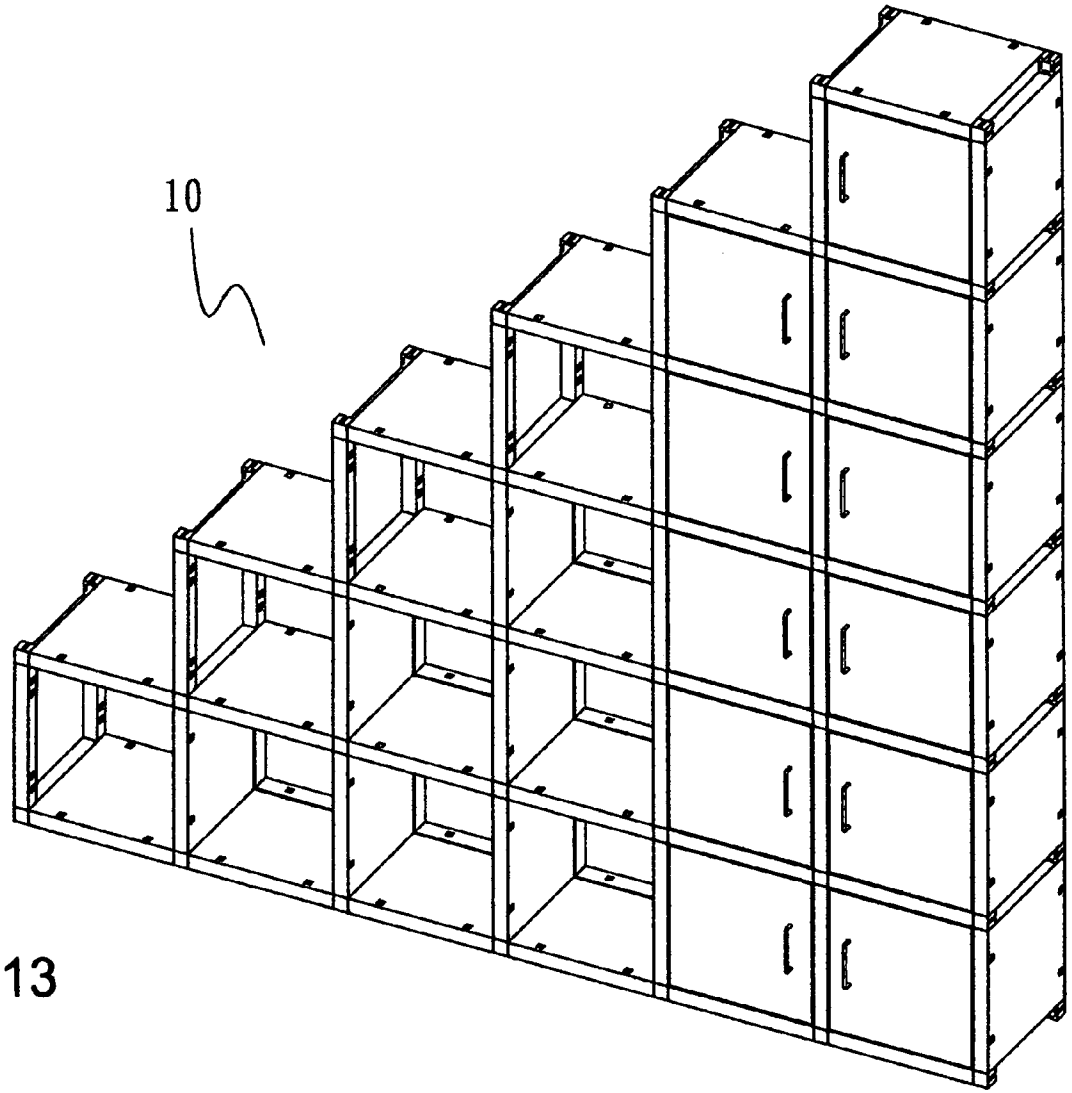
FIG. 13 is a perspective view of the first embodiment a of final configuration to show the systemic cabinet arranged in a ladder-shape.
Figure 14:
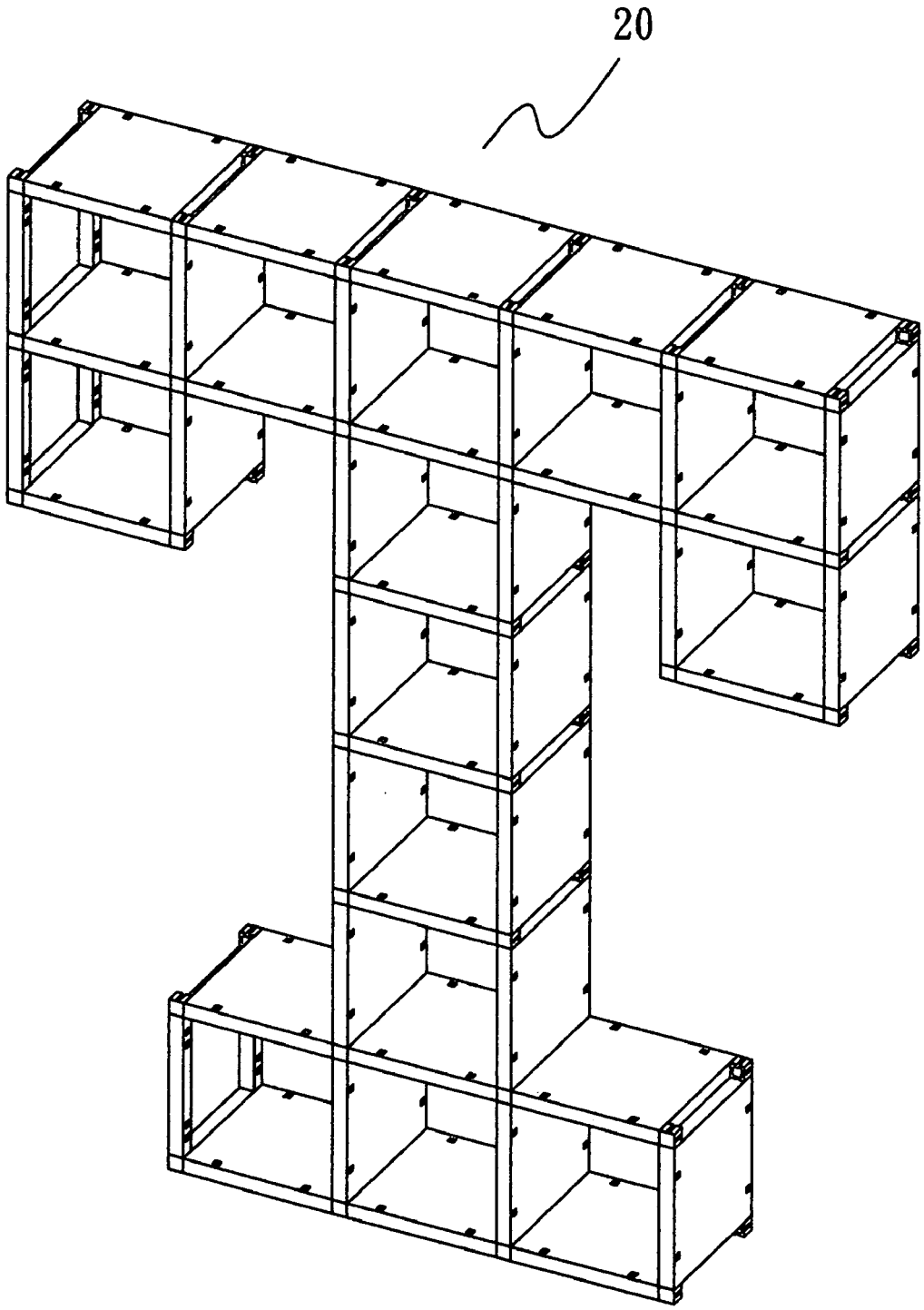
FIG. 14 is a perspective view of the second embodiment of a final configuration to show the systemic cabinet arranged in a T-shape.
Figure 15:
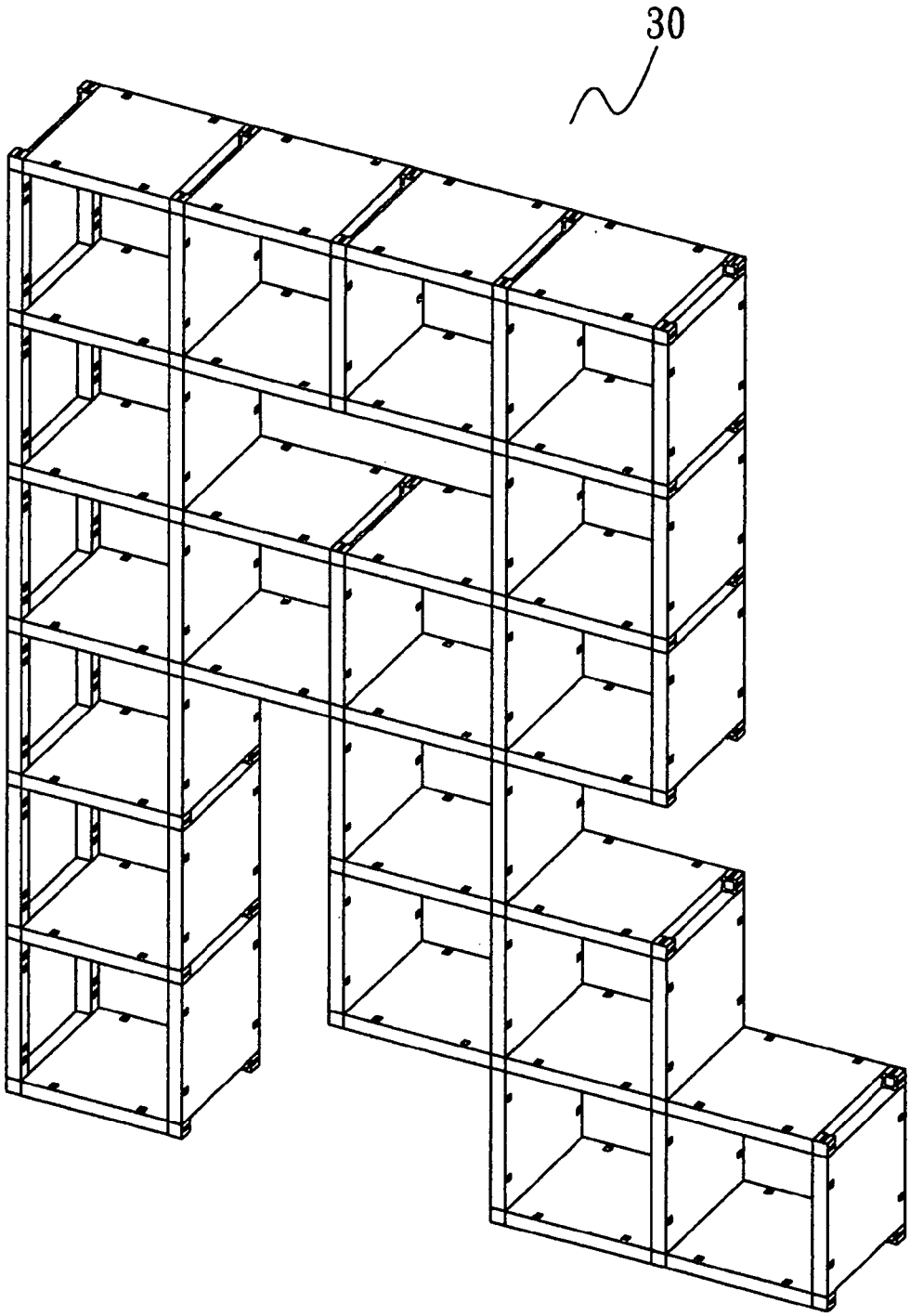
FIG. 15 is a perspective view of the third embodiment of a final configuration to show the systemic cabinet arranged in a R-shape.
Figure 16:
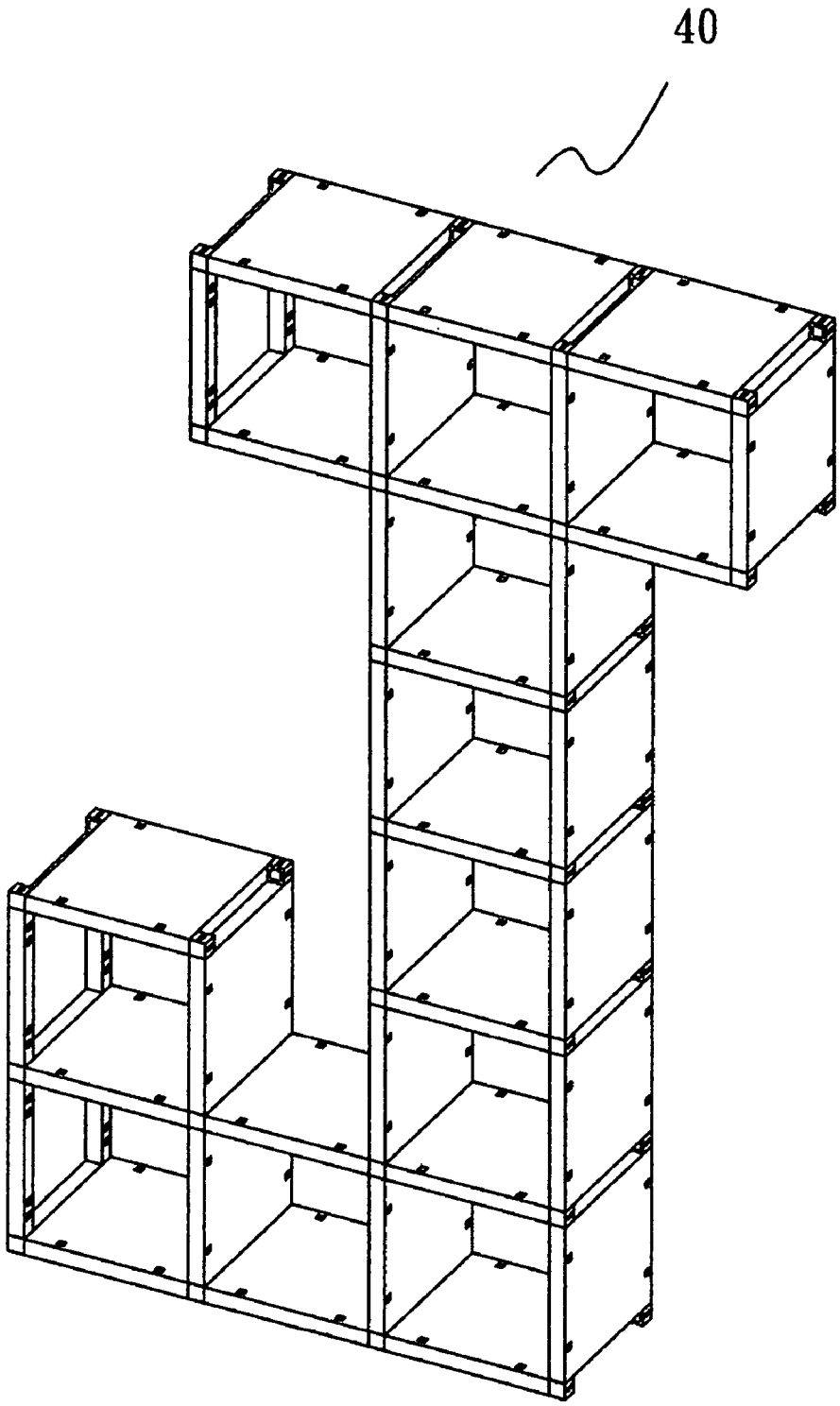
FIG. 16 is a perspective view of the fourth embodiment of a final configuration to show the systemic cabinet arranged in a J-shape.
Figure 17:
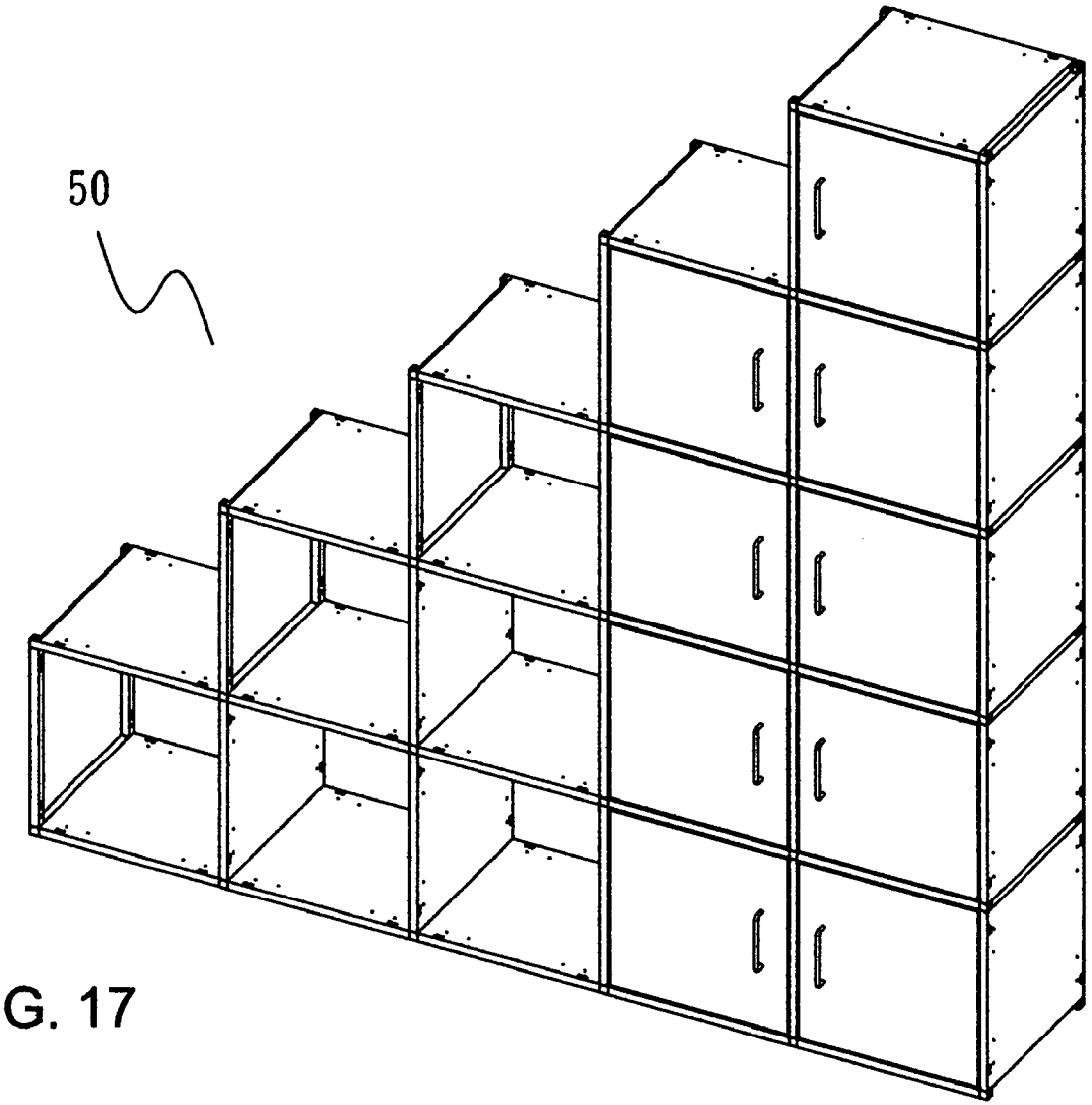
FIG. 17 is a perspective view of the first embodiment of a final configuration to show the systemic cabinet composed of multiple enlarged unit components arranged in a ladder shape.
Figure 18:
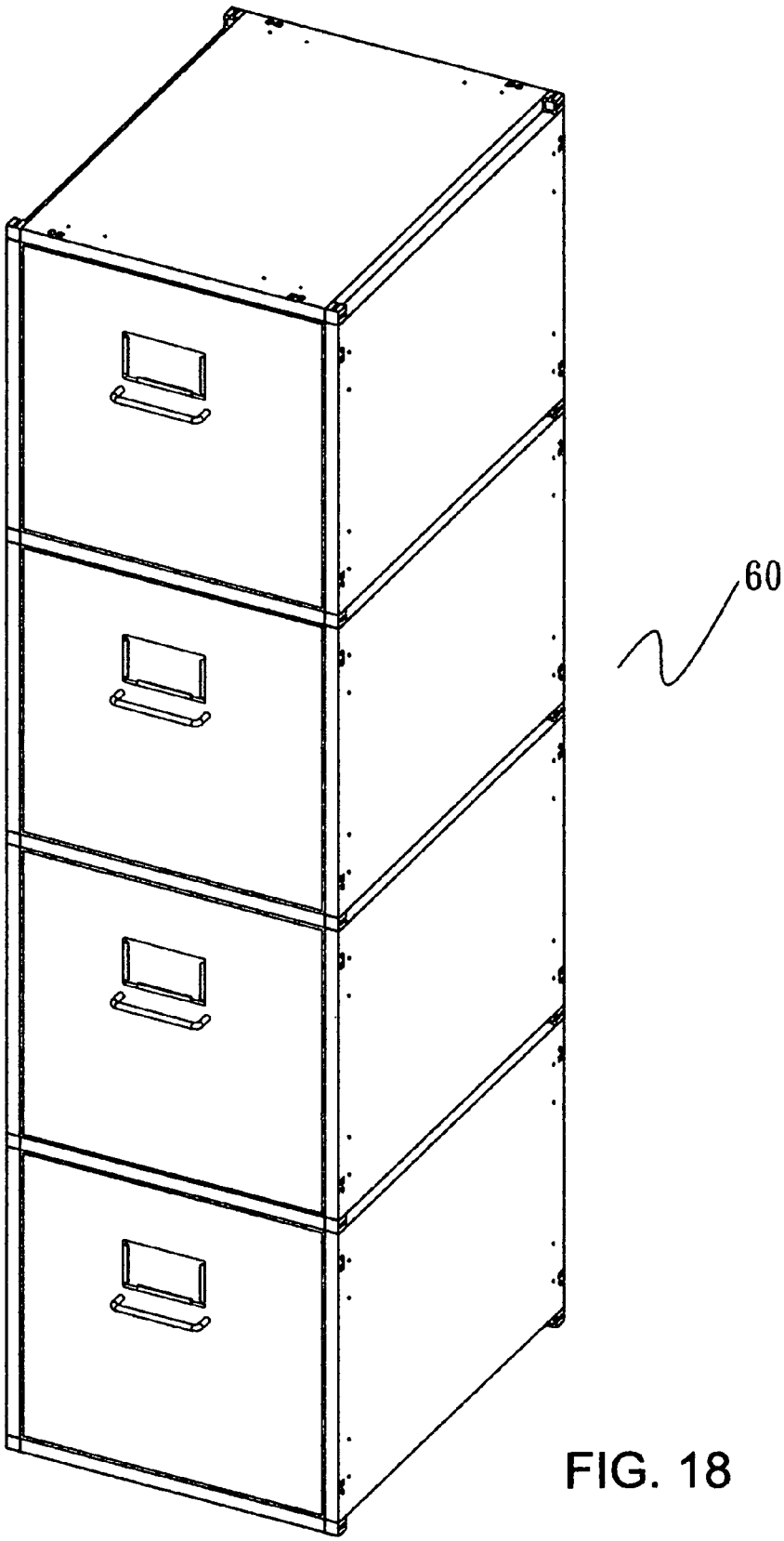
FIG. 18 is a perspective view of a second embodiment of a final configuration to show the systemic cabinet composed of multiple enlarged unit components with drawers arranged vertically.
Figure 19:
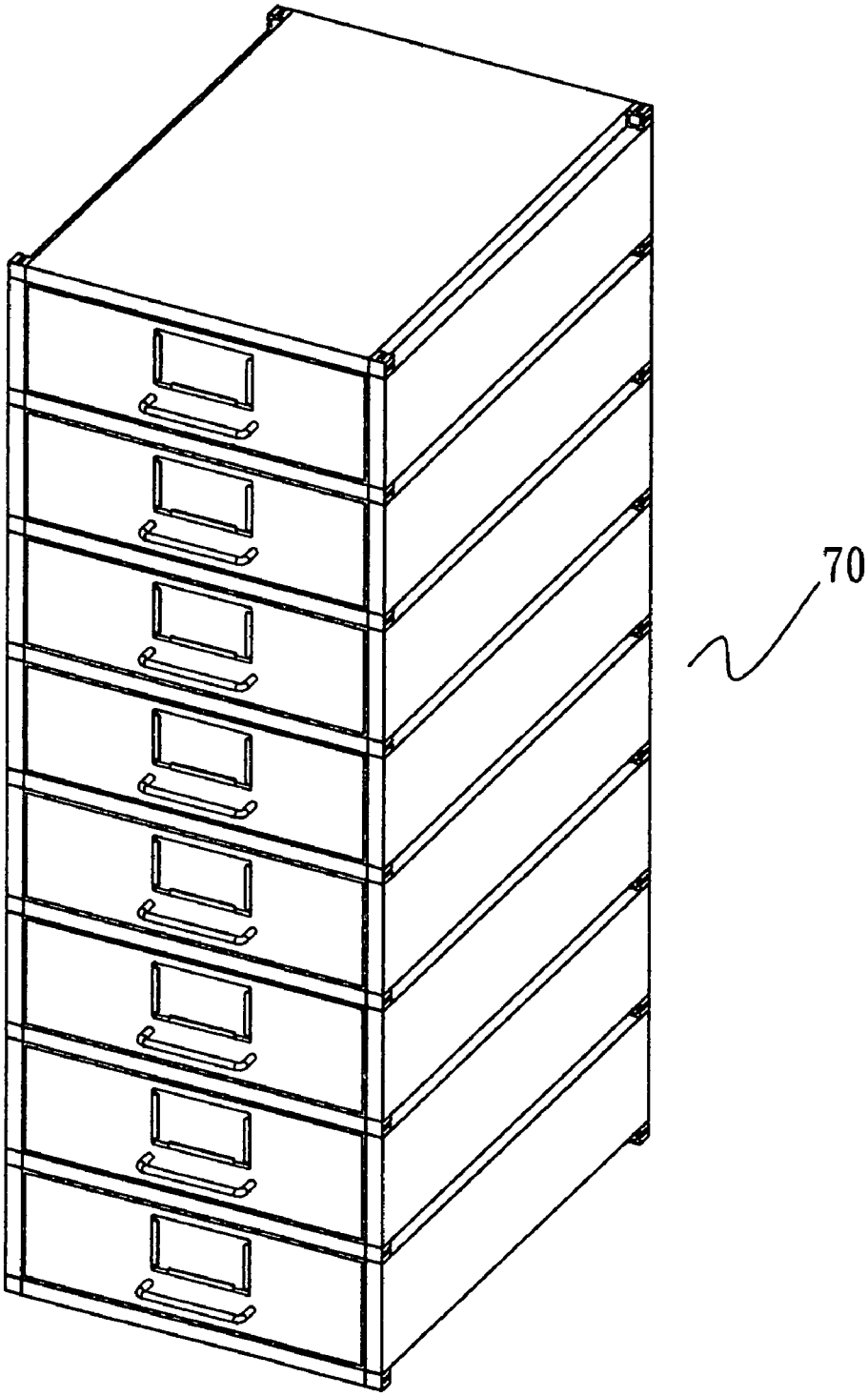
FIGS. 19-24 are perspective views of the third to seventh embodiments of final configurations of the systemic cabinets.
Figure 20:
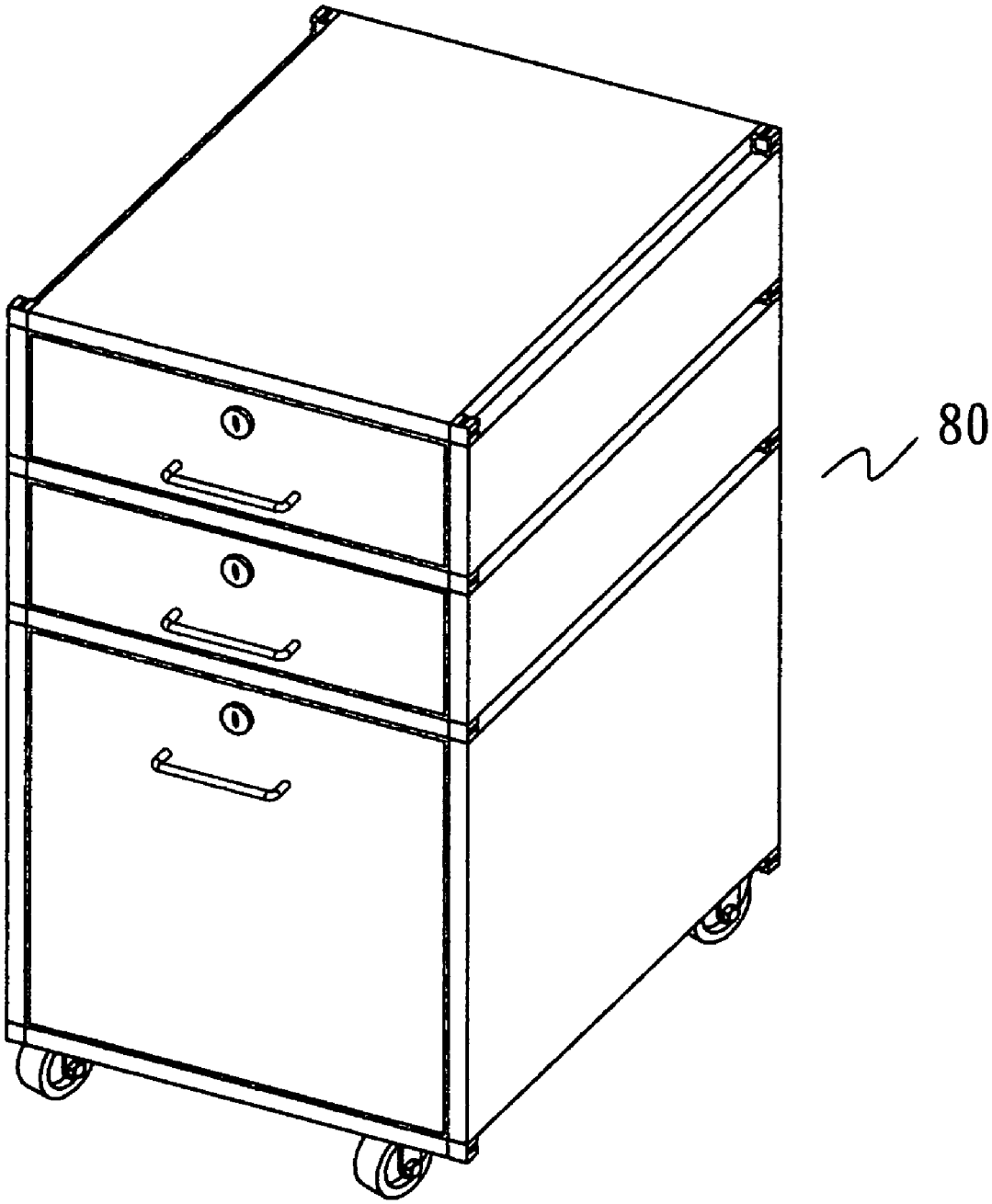
Figure 21:
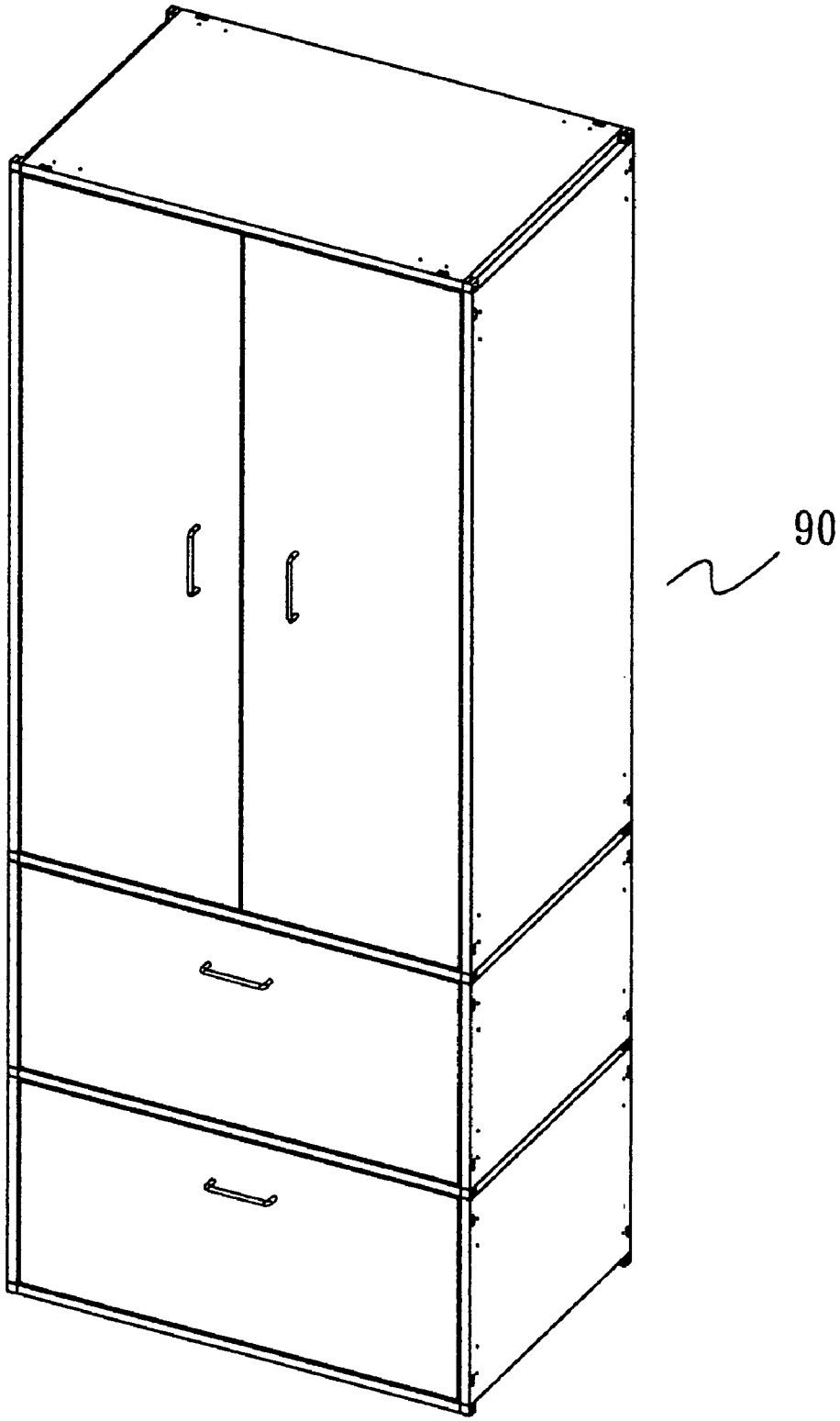
Figure 22:
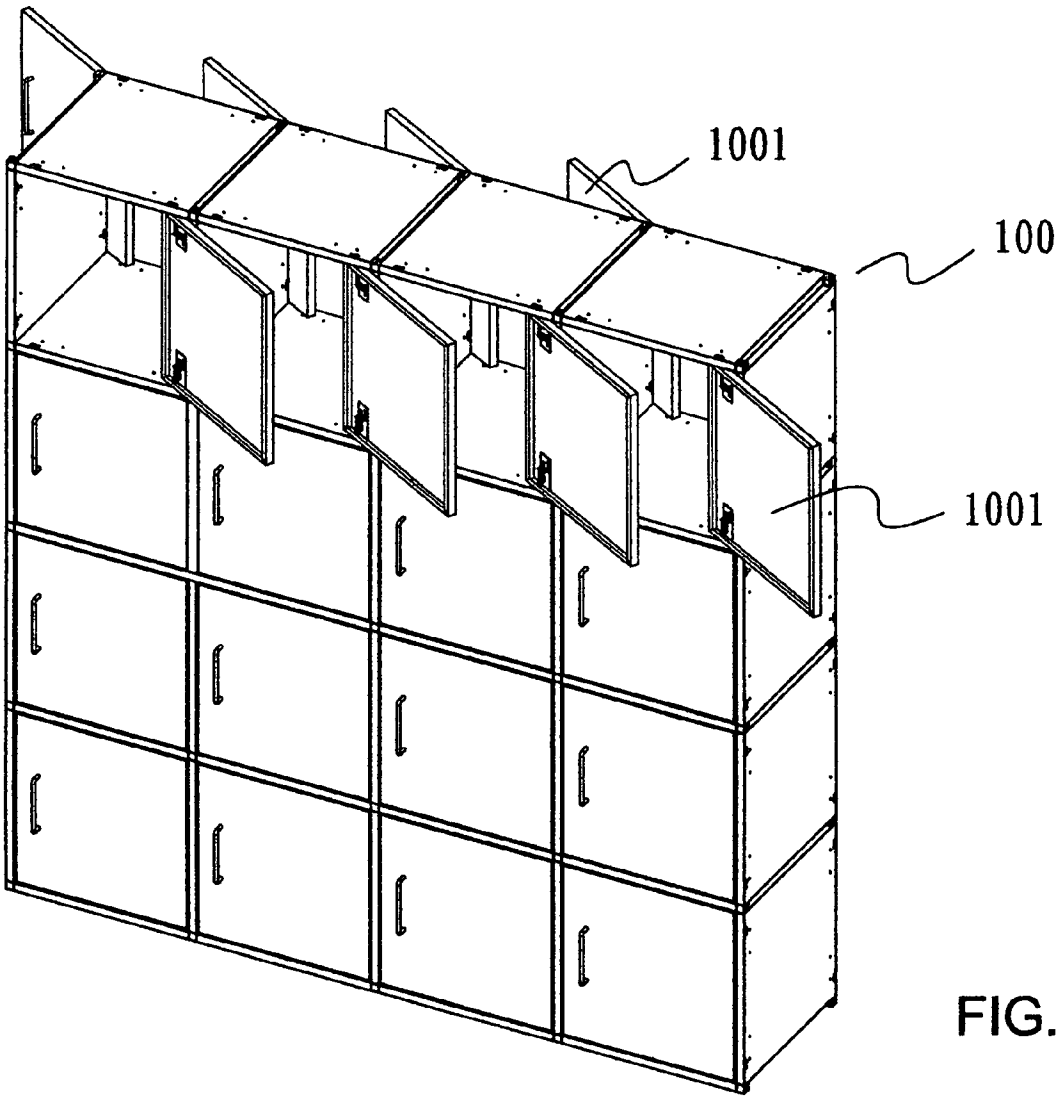
Figure 23:
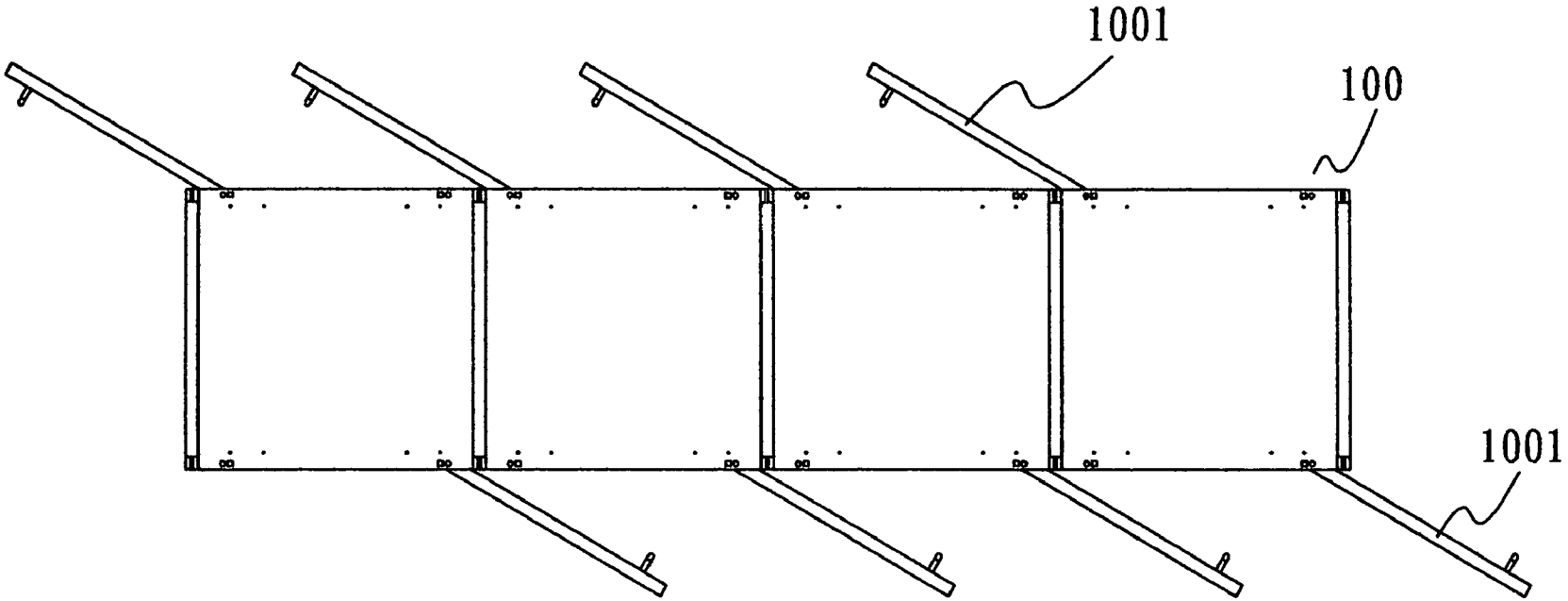
Figure 24:
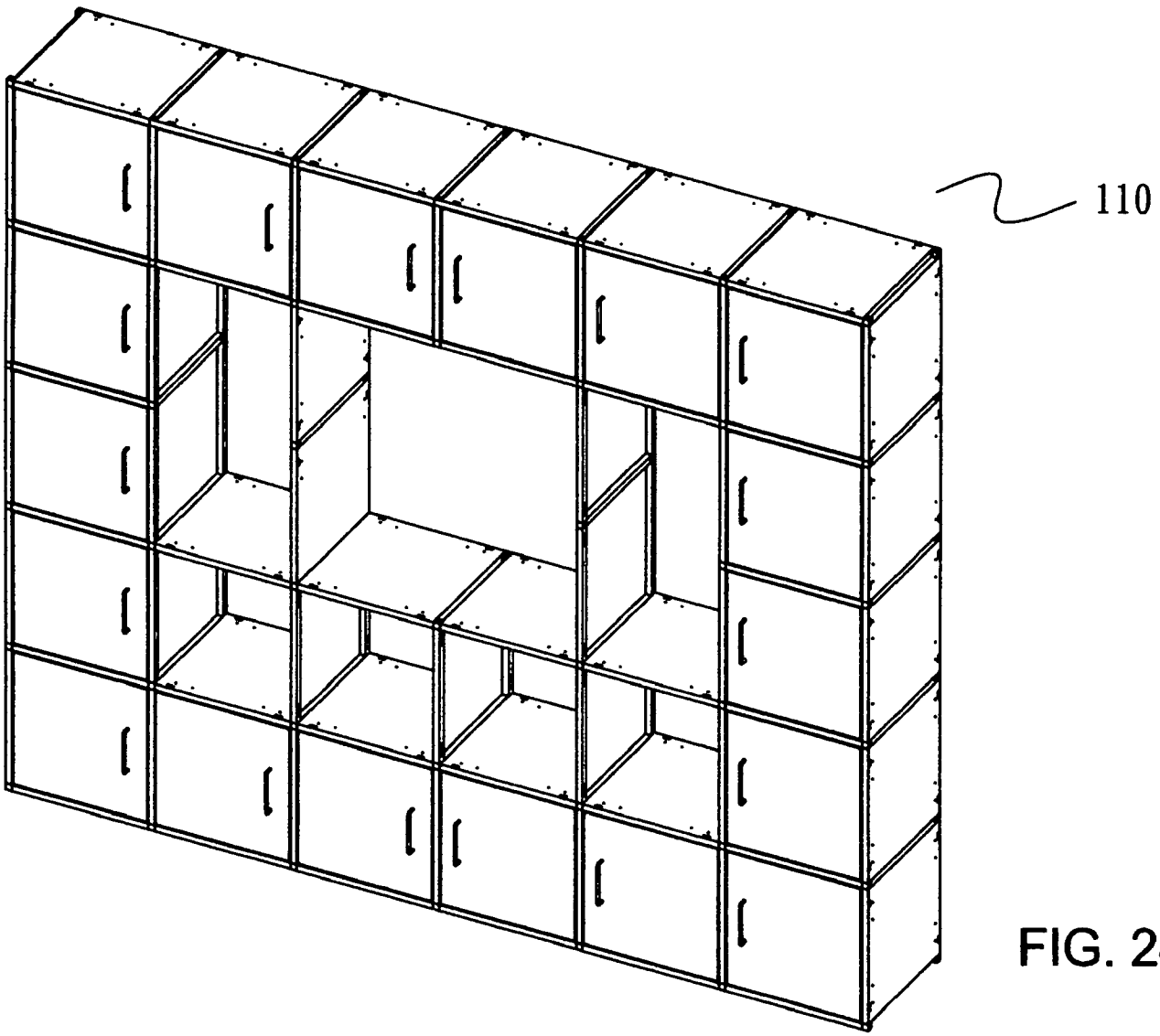

The aforementioned unit components 5 can be modified to different arrangements such as a ladder-shape configuration 10 as shown in FIG. 13, a T-shape configuration 20 as shown in FIG. 14, a R-shape configuration 30 as shown in FIG. 15, and a J-shape configuration 40 as shown in FIG. 16 for creating fun in decoration. With regard to unit components 5' with a widened size can be modified to different arrangements such as a ladder-shape configuration 50 as shown in FIG. 17, multiple file cabinet configurations 60, 70 and 80 as shown in FIGS. 18-20, a closet configuration 90 as shown in FIG. 21, a staked configuration 100 for which each compartment has cover boards 1001 at front and rear faces as shown in FIGS. 22 and 23, and a staked configuration 110 having compartments with different sizes for creating more utility in use as shown FIG. 24.

The aforementioned systemic cabinet has the following advantages in assembly and practice:

1. By composing multiple boards with multiple connecting pieces to form the predetermined cabinet, the assembling operation is quick and convenient, and the combined cabinet is stable and firm.

2. Once the systemic cabinet is worn out due to too much use, only the broken parts of the systemic cabinet can be replaced by detaching the relative connecting pieces easily for material saving. Otherwise, the whole systemic cabinet can be disassembled into pieces to reduce occupied space during a recycling process for environmental protection.

3. The unit components for the systemic cabinet are variable to extend and create more embodiments both for utility purposes and for decorative purposes.

Although this invention has been described in its preferred form with a certain degree of particularity, it is understood that the present invention of the preferred forms has been made only by way of example, and that numerous changes in the details of construction and the combination and arrangement of parts may be resorted to without departing from the spirit and scope of the invention.

What is claimed is:

1. A systematic cabinet comprising:

i) first and second boards each with two opposite lateral sides, wherein each of the first and second boards includes mortises defined at two ends of each of said two opposite lateral sides thereof, with each mortise extending in a mortise direction for a preset length; and ii) connecting pieces for inserting into said mortises when joining the first and second boards, wherein each of said connecting pieces includes:

ii.a) a solid locking body of six congruent faces, with the locking body including first and second dovetail-grooves separately defined on one of said six congruent faces without transversally grooving, with a central block section maintained between each of the first and second dovetail grooves and another of said six congruent faces; and ii.b) first and second tenon tubes engaged with the locking body, wherein each tenon tube has four lateral faces slideably received in the mortise direction in mortises of the first and second boards, with the first and second dovetail grooves extending perpendicular to the mortise direction and to the central block section, with the locking body having solid cross sections perpendicular to the first and second dovetail-grooves.

2. The systemic cabinet as claimed in claim 1, wherein the first and second tenon tubes are integrally formed onto said locking body for engaging said mortises when joining said boards.

3. The systemic cabinet as claimed in claim 2, wherein each of said connecting pieces further comprises:

a third tenon tube having a dovetail for engaging one of said first and second dovetail-grooves of said locking body.

4. The systemic cabinet as claimed in claim 2, wherein each of said boards further includes a locking hole communicating with said mortises; and each of said first and second tenon tubes includes a protrusion corresponding to said locking hole for engaging the locking hole.

5. The systemic cabinet as claimed in claim 4, further comprising a rear board of a top side, a bottom side and four lateral sides including multiple positioning protrusions formed at said top side and said bottom side thereof respectively; and each of said first and second boards includes multiple through holes for engaging said positioning protrusions of said rear board.

6. The systemic cabinet as claimed in claim 2 wherein each of the first and second tenon tubes includes a non-lateral face having a dovetail received in one of the first and second dove-tail grooves of the locking body.

7. The systemic cabinet as claimed in claim 1 wherein each of the first and second tenon tubes includes a non-lateral face having a dovetail received in one of the first and second dove-tail grooves of the locking body.

8. The systemic cabinet as claimed in claim 7 wherein the locking body and the first and second tenon tubes are arranged in an L-shape.

9. The systemic cabinet as claimed in claim 8, wherein each of said connecting pieces further comprises:

a third tenon tube having a dovetail for engaging one of said first and second dovetail-grooves of said locking body.

10. The systemic cabinet as claimed in claim 7, wherein each of said boards further includes a locking hole communicating with said mortises; and each of said first and tenon tubes includes a protrusion corresponding to said locking hole for engaging the locking hole.

11. The systemic cabinet as claimed in claim 7, further comprising a rear board of a top side, a bottom side and four lateral sides including multiple positioning protrusions formed at said top side and said bottom side thereof respectively; and each of said first and second boards includes multiple through holes for engaging said positioning protrusions of said rear board.

12. The systemic cabinet as claimed in claim 1, wherein each of said boards further includes a locking hole communicating with said mortises; and each of said first and tenon tubes includes a protrusion corresponding to said locking hole for engaging the locking hole.

* * * * *